US011272733B2

(12) United States Patent
Fallon et al.

(10) Patent No.: US 11,272,733 B2
(45) Date of Patent: Mar. 15, 2022

(54) METHODS AND EQUIPMENT FOR GATHERING FIBRES

(71) Applicants: British American Tobacco (Investments) Limited, London (GB); Tobacco Research and Development Institute (Proprietary) Limited, Stellenbosch (ZA)

(72) Inventors: Gary Fallon, London (GB); John Richardson, Hampshire (GB); Ian King, Hampshire (GB); Gerhard Malin Le Roux, Stellenbosch (ZA); Arnold Leslie Herholdt, Stellenbosch (ZA)

(73) Assignees: BRITISH AMERICAN TOBACCO (INVESTMENTS) LIMITED, London (GB); TOBACCO RESEARCH AND DEVELOPMENT INSTITUTE (PROPRIETARY) LIMITED, Stellenbosch (ZA)

( * ) Notice: Subject to any disclaimer, the term of this patent is extended or adjusted under 35 U.S.C. 154(b) by 175 days.

(21) Appl. No.: 16/339,568

(22) PCT Filed: Sep. 18, 2017

(86) PCT No.: PCT/GB2017/052766
§ 371 (c)(1),
(2) Date: Apr. 4, 2019

(87) PCT Pub. No.: WO2018/065749
PCT Pub. Date: Apr. 12, 2018

(65) Prior Publication Data

US 2019/0239557 A1 Aug. 8, 2019

(30) Foreign Application Priority Data

Oct. 5, 2016 (GB) ..... 1616932

(51) Int. Cl.
*A24D 3/02* (2006.01)

(52) U.S. Cl.
CPC ..... *A24D 3/0229* (2013.01)

(58) Field of Classification Search
CPC ..... A24D 3/0229; A24D 3/0241
(Continued)

(56) References Cited

U.S. PATENT DOCUMENTS 3,095,343 A * 6/1963 Berger ..... B43K 15/02 156/180
3,684,622 A 8/1972 Goldsworthy
(Continued)

FOREIGN PATENT DOCUMENTS

EP 0224892 A1 6/1987
EP 2548625 A1 1/2013
(Continued)

OTHER PUBLICATIONS

Russian Search Report for corresponding application 2019129856/05 filed Mar. 15, 2018; Report dated Mar. 25, 2020.
(Continued)

*Primary Examiner* — Robert F Long
*Assistant Examiner* — Xavier A Madison
(74) *Attorney, Agent, or Firm* — Cantor Colburn LLP

(57) ABSTRACT

A method of, and equipment for gathering fibres (12) entrained a gas stream, for example by melt blowing, comprises an enclosure (50) having an inlet (57), through which a gas stream carrying entrained fibres (12) may be directed into the enclosure (50), a fibre outlet (58) from which an assembly of gathered fibres (12) may be withdrawn from the enclosure (50) and an exhaust outlet (41) through which gas may pass out of the enclosure (50). The enclosure (50) is constructed to provide a pathway for the fibres (12) from the inlet (57) to the fibre outlet (58) in which
(Continued)

surplus gas in the gas stream is separated from the entrained fibres (12) and directed to the exhaust outlet (41), thereby reducing turbulence in the fibres (12) in the enclosure (50) which may affect the quality of the finished assembly.

16 Claims, 15 Drawing Sheets

(58) Field of Classification Search
USPC ..... 131/332
See application file for complete search history.

(56) References Cited

U.S. PATENT DOCUMENTS

| | | | | |
|---|---|---|---|---|
| 3,802,817 | A * | 4/1974 | Matsuki | D04H 3/03 425/66 |
| 3,826,177 | A | 7/1974 | Berger | |
| 4,286,005 | A | 8/1981 | Berger | |
| 4,340,563 | A * | 7/1982 | Appel | B32B 37/15 264/518 |
| 4,508,525 | A | 4/1985 | Berger | |
| 4,549,875 | A | 10/1985 | Pryor | |
| 4,812,112 | A * | 3/1989 | Balk | D01G 25/00 425/66 |
| 5,382,153 | A * | 1/1995 | Nettelnstroth | A61F 13/2082 156/166 |
| 5,911,224 | A | 6/1999 | Berger | |
| 6,499,981 | B1 * | 12/2002 | Yoshida | D04H 3/16 425/66 |
| 6,783,722 | B2 * | 8/2004 | Taylor | D01D 5/0985 264/103 |
| 7,132,071 | B2 | 11/2006 | Smith | |
| 8,591,683 | B2 * | 11/2013 | Fox | B01D 39/163 156/167 |
| 2004/0238991 | A1 | 12/2004 | Smith | |
| 2005/0008728 | A1 * | 1/2005 | Wilkie | D01D 13/02 425/72.2 |
| 2011/0293764 | A1 * | 12/2011 | Hartge | D01D 5/092 425/72.2 |
| 2013/0023395 | A1 | 1/2013 | Nakamura | |
| 2014/0243178 | A1 * | 8/2014 | Matern | A24D 3/0237 493/39 |

FOREIGN PATENT DOCUMENTS

| | | | |
|---|---|---|---|
| EP | 2641484 | A2 | 9/2013 |
| GB | 1526151 | | 9/1978 |
| JP | 52104577 | | 9/1977 |
| RU | 53290 | U1 | 5/2006 |
| UA | 28376 | U | 12/2007 |
| WO | 9516369 | A1 | 6/1995 |
| WO | 0141590 | A1 | 6/2001 |
| WO | 03085185 | A2 | 10/2003 |
| WO | 2004104485 | A2 | 12/2004 |
| WO | 2011114440 | A1 | 9/2011 |
| WO | 2015011830 | A1 | 1/2015 |
| WO | 2015028812 | A1 | 3/2015 |
| WO | 2016097016 | A1 | 6/2016 |
| WO | 2018172742 | A1 | 9/2018 |

OTHER PUBLICATIONS

International Preliminary Report on Patentability for corresponding application PCT/GB2017/052766 filed Sep. 18, 2017; dated Jan. 28, 2019.
International Search Report for corresponding application PCT/GB2017/052766 filed Sep. 18, 2017; dated Dec. 7, 2017.
Written Opinion of the International Searching Authority for corresponding application PCT/GB2017/052766 filed Sep. 18, 2017; dated Dec. 7, 2017.
British Search Report for corresponding application GB1704692.1: Report dated Jun. 8, 2017.
British Search Report for corresponding application GB1704700.2; Report dated Jun. 22, 2017.
International Preliminary Report on Patentability for corresponding applicating PCT/GB2018/050668 filed Mar. 15, 2018; dated Apr. 11, 2019.
International Preliminary Report on Patentability for corresponding application PCT/GB2018/050661 filed Mar. 15, 2018; dated Jun. 25, 2019.
International Search Report for corresponding applicating PCT/GB2018/050668 filed Mar. 15, 2018; dated Jun. 13, 2018.
International Search Report for corresponding application PCT/GB2018/050661 filed Mar. 15, 2018; dated Jun. 7, 2018.
International Search Report for corresponding application PCT/GB2018/050670 filed Mar. 15, 2018; dated Jun. 6, 2018.
Written Opinion of the International Searching Authority for corresponding applicating PCT/GB2018/050668 filed Mar. 15, 2018; dated Jun. 13, 2018.
Written Opinion of the International Searching Authority for corresponding application PCT/GB2018/050661 filed Mar. 15, 2018; dated Jun. 7, 2018.
Written Opinion of the International Searching Authority for corresponding application PCT/GB2018/050670 filed Mar. 15, 2018; dated Jun. 6, 2018.
Chinese Search Report for corresponding application 201880034418.0 filed Mar. 15, 2018; Report dated Apr. 2, 2021.

* cited by examiner

METHODS AND EQUIPMENT FOR GATHERING FIBRES

FIELD OF THE INVENTION

The field of the invention is methods and equipment for gathering fibres to form assemblies such as fibre webs, skeins or rods, particularly webs and skeins of filter tow, filter rods and cigarette filters.

BACKGROUND

Numerous products formed from fibrous material may be produced by gathering the fibers into an assembly, for example a thread, web, skein, roving, mat, or rod. Such assemblies may be treated to retain the fibres in a cohesive whole, for example by heating, or by applying an adhesive or plasticiser, to cause the fibres to adhere to each other at their points of contact. For example, cigarette filters may be formed from fibres of filter material, such as cellulose acetate fibres, by gathering the fibres to form a strand or skein of entangled fibres, often referred to as filter tow, and then compressing the strand by rolling and drawing to form rods of higher density, which can then be wrapped and cut into individual short lengths suitable of incorporation on cigarette.

In processes and equipment for gathering fibres, it is desirable to reduce variations in the density fibres in the assembly, since such variation may affect the quality of the end product.

SUMMARY

This patent specification discloses equipment for gathering fibres entrained a gas stream, the equipment comprising an enclosure having an inlet through which a gas stream carrying entrained fibres may be directed into the enclosure, a fibre outlet from which gathered fibres may be withdrawn from the enclosure, and an exhaust outlet through which gas may pass out of the enclosure, and constructed to provide a pathway for the fibres through the enclosure from the inlet to the fibre outlet, to separate surplus gas in the gas stream from the entrained fibres, and to direct the surplus gas to the exhaust outlet.

This patent specification also discloses an enclosure for use in equipment for gathering fibres entrained a gas stream, the enclosure defining an inlet, through which a gas stream carrying entrained fibres may be directed into the enclosure, a fibre outlet from which gathered fibres may be withdrawn from the enclosure, and an exhaust outlet through which gas may pass out of the enclosure, wherein the enclosure provides a pathway for the fibres from the inlet to the fibre outlet and is constructed to direct surplus gas in the gas stream away from the entrained fibres.

In an embodiment, the enclosure is constructed to direct gas and fibres into the inlet and surplus gas outside the enclosure. Alternatively, or in addition, the enclosure may be constructed to effect separation of surplus gas from the fibres at one or more locations within the enclosure.

Separation of the surplus gas from the fibres can be effective in reducing turbulence in the fibres, as they pass through the enclosure, and may facilitate the gathering of the fibres into a more uniform assembly.

The enclosure may be constructed wholly or partially to enclose or surround the pathway for the fibres through the enclosure from the inlet to the fibre outlet.

The equipment or the enclosure may define a number of different zones for handling the gas stream and the entrained fires. For example, in one embodiment of the equipment, the enclosure comprises a receiving zone, into which the gas stream may be directed through the inlet, a stabilizing zone downstream of the receiving zone through which the fibres may pass towards the fibre exit, and an exhaust zone through which the surplus gas may be directed to the exhaust outlet.

The fibres may be entrained in the stream of gas by any suitable process, for example a melt blowing process. Accordingly, in one embodiment, the fibre gathering equipment may further comprise melt blowing equipment for generating fibres of plastics material entrained in a gas stream, and arranged to direct the gas stream into the enclosure.

In a typical melt blowing process, fiber-forming polymer is extruded from one or more orifices into convergent streams of hot gas (for example air or possibly an inert gas). The gas blows the polymer emerging from the orifices into thin streams of molten polymer, which then solidify to form small diameter fibres. The fibres are entrained in the stream of gas and may be collected, for example by directing the stream of gas and fibers on to a collection surface. The resulting assembly, composed of entangled fibres, may be treated, e.g. by heating, to fuse the fibres together at their points of contact to provide a nonwoven fibrous assembly.

This specification also discloses a method of forming an assembly of gathered fibres comprising entraining fibres in a stream of gas; directing the stream of gas and entrained fibres into a space that is wholly or partially enclosed; gathering the fibres together in the enclosed space; withdrawing the gathered fibres from the enclosed space; and discharging the gas from the enclosed space; wherein surplus gas is separated from the gas stream and diverted away from the gathered fibres to reduce turbulence in the gathered fibres.

The separation of the surplus gas from the gas stream may be effected in one or more stages. In one stage, the entrained fibres may be directed into the enclosed space, and surplus gas may be directed outside the enclosed space. Alternatively, or in a further stage, the separation of surplus gas from the gas stream and the entrained fibres may be effected within the enclosed space. In further alternative methods, the surplus gas may be separated from the gas stream in a plurality of successive stages within the enclosed space.

The methods and equipment disclosed herein may be used to provide fibrous assemblies; in particular webs, mats, threads, skeins, rovings, rods, filter tow, and filter rods. For example, rods of fibres may be formed by forming a web of fibres by a method or using equipment disclosed herein, and further forming the web into a continuous rod or filter rods, using for example known rod-making machinery.

The equipment may be constructed to gather together fibres entrained in the gas stream to form a web. For this purpose, a collector may be provided in the enclosure, more particularly in a receiving zone thereof. The collector may have a collection surface aligned with the inlet and positioned to gather fibres entrained with the gas stream.

Accordingly, in one embodiment of the method, the fibres are gathered by directing the stream of gas and entrained fibres on to a collecting surface, and causing relative movement between the collecting surface and the gas stream.

The collector may be incorporated in a transport system that moves the gathered fibres along at least part of the pathway through the enclosure. For example the transport system may have an upstream portion, which may be located in a receiving zone, disposed in alignment with the inlet to collect entrained fibres from the gas, and arranged to move fibres deposited thereon through the chamber towards the fibre outlet.

In one embodiment, equipment for gathering fibres entrained in a gas stream comprises a transport surface for moving fibres deposited thereon from a receiving zone to a stabilisation zone; an enclosure at least partially covering the transport surface and defining a chamber extending from the receiving zone to the stabilisation zone, an inlet, through which fibres entrained in the gas stream may be directed into the chamber and on to the transport surface, a fibre outlet from which fibres on the transport surface may be withdrawn from the enclosure as a web, and an exhaust outlet for the gas positioned away from the fibre outlet, the enclosure being configured to separate surplus gas in the gas stream from the fibres and to direct the surplus gas to the outlet.

The transport system may be arranged to move the fibres in a different direction from the direction of the gas stream. For example the fibres and the surplus gas may be directed generally orthogonally, or at right angles to each other. Similarly, the inlet may be arranged to receive the gas stream in a direction generally at right angles or generally normal to the direction of movement of the transport system.

The transport system may for example be in the form of a conveyor such as an endless conveyor belt or a rotatable collector drum. Alternatively the transport system may include a slide surface, over which the fibres may pass from the inlet to the fibre outlet under the influence of gravity and or the gas stream, or rollers for drawing fibres through or out of the chamber.

The conveyor may be constructed to allow the passage of gas from the gas stream whilst supporting fibres thereon. For example the conveyor may comprise a perforated or porous sheet or belt of flexible material or a chain of links in which adjacent links are spaced apart to allow the passage of gas through the conveyor.

In one embodiment, the enclosure is configured to direct substantially all the surplus gas within the enclosure to the exhaust outlet. In another embodiment the enclosure is configured to direct a minor proportion of the surplus gas within the enclosure to the fibre outlet to leave the chamber together with the fibres.

In an embodiment of the method, surplus gas is diverted from the periphery of the gas stream, for example upstream of a fibre collecting surface.

In an embodiment of the equipment, the gas stream may be funneled in its direction of flow into a region of smaller cross-sectional area as it approaches the collecting surface and surplus gas on the periphery is diverted laterally away from the direction of flow.

In one embodiment of the equipment, one or more baffles may be provided in the enclosure to separate surplus gas in the gas stream from the entrained fibres, and/or to direct surplus gas away from the gas stream. One or more baffles may also be provided to direct the surplus gas to the exhaust outlet, thereby to reduce turbulence in the fibres as they pass through the enclosure.

One or more baffles may also be provided to direct fibre in the gas stream on to the transport surface or conveyor, and surplus gas in the gas stream away therefrom.

In one embodiment of the equipment, at least one baffle may be provided with one or more louvres. The louvres may be arranged for example to direct fibres in one direction away from the baffle, whilst allowing gas to flow through the baffle in either direction. Each louvre comprises an aperture in the baffle, for example in the form of a rectilinear or arcuate slot arranged transversely to the direction of flow of gas over the surface of the baffle when in use. The louvres may be arranged in any effective configuration, depending upon the direction of flow of the gas over the baffle. For example the louvres may be in the form of a single column of elongated parallel slots, or as an array of slots having multiple columns in one or more rows.

In an embodiment, a baffle is positioned in the path of the gas stream and arranged to direct fibres from the gas stream into a primary passage, and surplus gas from the gas stream into an auxiliary passage separate from the primary passage.

The primary passage may be tubular, and of any desired cross sectional shape, e.g. circular, rectangular, hexagonal, or otherwise polygonal. The auxiliary passage may surround the first passage, e.g. in an annular configuration. Alternatively, the primary and auxiliary passages may lie alongside each other, or separately from each other. In such arrangements, additional auxiliary passages may be provided. For example, with a rectangular primary passage, up to four auxiliary passages may be used, one adjacent a respective one of the four walls of the primary passage. The shared wall of the primary and secondary passage may provide a baffle for diverting surplus gas from the periphery of the gas stream away from the fibres into the secondary passage, the fibres and gas in the main gas stream being directed into the primary passage.

In one embodiment of the equipment, the primary passage has an entrance adjacent the inlet that is arranged to receive fibres, and an exit that is arranged to direct fibres on to a first region within the enclosure, and the auxiliary passage lies alongside the main passage and has an entrance that is arranged to receive gas from the periphery of the gas stream, and an exit that is arranged to direct surplus gas to a second region within the enclosure.

The first region may for example contain a collector constructed to gather together fibres entrained in the gas stream to form a web, or a conveyor arranged to move the fibres along part of the pathway, and the second region may lie to one side of on the collector or conveyor.

In such an arrangement, the lateral width of the primary passage may decrease towards the first region. The lateral width of the auxiliary passages may increase towards the second region.

To form the fibres into a web of desired width and thickness, the enclosure may comprises a conduit, for example located upstream of the fibre orifice, having an elongated section of substantially uniform cross sectional shape along is length through which fibres may pass towards the fibre outlet.

In one embodiment of the equipment, a guide is provided in the enclosure, through which fibres may pass into the conduit, the guide having a cross section that tapers towards the elongated section of the conduit.

In one embodiment of the method, surplus air adjacent the gathered fibres is diverted away there from to facilitate separation of the gathered of the web from the collection surface. For this purpose, the fibre outlet may comprise an outlet orifice that discharges into an open channel extending in the direction of movement of the gathered fibres. A baffle may be arranged to direct gas emerging from the orifice away from the direction of movement of the fibres.

In an embodiment of the method, the diverted surplus air is removed by pressure reduction. Alternatively the equipment may be arranges so that the surplus air discharges from the equipment under its own pressure.

In an embodiment of the equipment, the enclosure includes an exhaust chamber arranged to receive the surplus gas, and the gas outlet is positioned in communication with the exhaust chamber, whereby surplus gas may be drawn from the equipment by pressure reduction, for example by means of a vacuum pump.

In an embodiment of the equipment, equipment for gathering fibres entrained a gas stream comprises an enclosure defining a separation chamber and an exhaust chamber, an inlet, through which a gas stream carrying entrained fibres may be directed into the separation chamber, baffles positioned in the separation chamber to separate surplus gas in the gas stream from the entrained fibres, thereby to reduce turbulence in the fibres as they pass through the separation chamber, and to direct the surplus gas to the exhaust chamber; an exhaust outlet through which gas may pass out of the exhaust chamber; a fibre outlet from which gathered fibres may be withdrawn from the separation chamber; and a transport system between the separation chamber and the exhaust chamber arranged to gather the fibres and to move them through the separation zone, the transport system being constructed to allow the passage of gas from the separation chamber to the exhaust chamber.

The equipment for gathering fibres disclosed herein may also be used in conjunction with rod forming equipment arranged to receive a web of fibres from the fibre outlet and to form the web into a continuous rod.

Embodiments of the equipment and methods will now be described, by way of example only, with reference to the accompanying drawings, in which.

In the drawings, for ease of reference, like pails or components in different embodiments have been given similar reference numerals.

Figure 1:
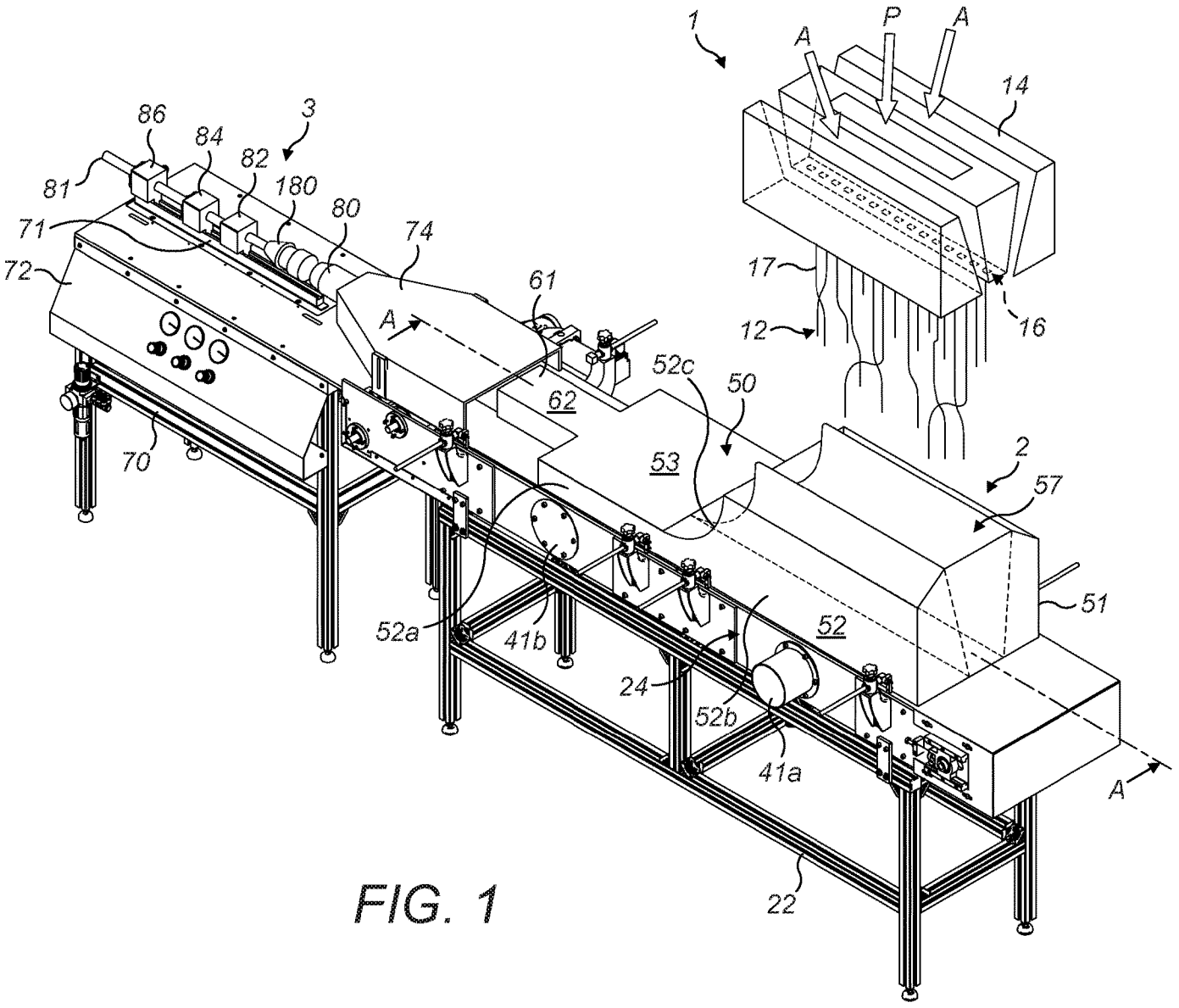
FIG. 1 is a perspective view in a downstream direction, from above and one side, of a first embodiment of equipment for gathering fibres entrained a gas stream and for forming the gathered fibres into a continuous rod of the kind used in cigarette filters.
Figure 2:
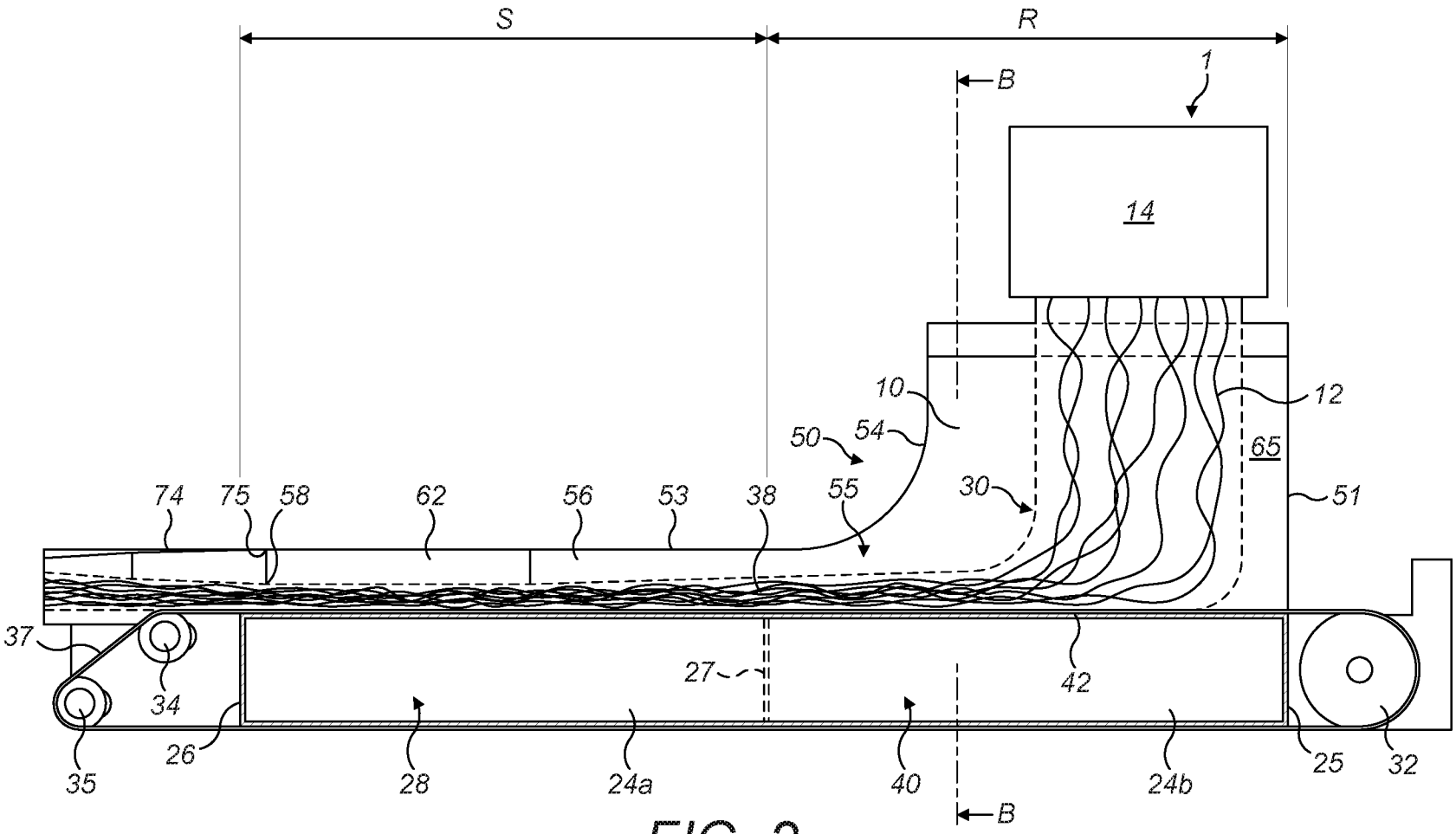
FIG. 2 is a schematic vertical cross-sectional view of part of the equipment of FIG. 1, taken along line A-A of FIG. 1.

Referring to FIGS. 1 and 2, the illustrated embodiment of the invention is equipment for forming rods of filter material suitable for use as cigarette filters. The equipment is of modular construction and comprises three modules: a melt blowing module 1, for generating fibres of a plastics material entrained in a gas stream, a fibre gathering module 2, for gathering the fibres from the melt blowing module 1 and forming a web 38 therefrom, and a rod forming module 3, for forming the web into a continuous rod 81.

Melt-Blowing Module

The melt blowing module 1 may be of conventional construction, and is illustrated schematically in the upper part of FIG. 1. The fundamental feature of the melt blowing module is a die head 14 into which molten polymer material indicated by the arrow P may be fed, and from which the molten polymer emerges as a liquid through an array of jets 16. Gas passages are formed in the die head immediately adjacent the jets. Hot gas, such as air, indicated by the arrows A, A, is fed into the die head and emerges from the gas passages as two convergent high velocity gas streams. The streams of hot gas blow the polymer emerging from the array of jets 16 into thin streams of molten polymer 17, which solidify within a few centimetres of the jets 16 to form a multiplicity of continuous small diameter fibres 12. The fibres 12 become entrained in the gas stream to form a complex pattern of entangled fibres entrained within a fast-flowing stream of gas.

Fibre Gathering Module

The fibre gathering module 2 is arranged vertically beneath the melt blowing module 1 to receive fibres entrained in the air stream therefrom. The vertical distance between the melt blowing module and the fibre gathering module is exaggerated in FIG. 1 for clarity.

The fibre gathering module 2 comprises a rigid frame 22 supporting a hollow casing 24 formed from metal plates welded or bolted together and secured to the supporting frame 22. The casing 24 is generally rectangular in plan with its major axis extending horizontally in a longitudinal direction from an upstream end 25 to a downstream end 26 and comprises two similarly shaped box units 24*a* and 24*b* (FIG. 2) with a removable partition 27 which divides the interior of the casing into two chambers. The partition 27 may be removed to place the two chambers in communication with each other.

As best seen in FIG. 2, a conveyor 28 is mounted on the casing 24, providing a transport system for moving fibres from the melt blowing module 1 part of the way along a pathway 30 (the envelope of which is indicated by broken lines in FIG. 2) through the fibre gathering module 2 to the rod forming module 3. The conveyor 28 comprises a tensioning roller 32 of relatively large diameter mounted in bearings fixed to the upstream end of the casing 24 for rotation about a horizontal axis that extends transversely of the casing. At the downstream end 26 of the casing 24, an idler roller 34 and a drive roller 35, each of smaller diameter than the tensioning roller, are mounted in bearings fixed to the casing 24 for rotation about horizontal axes parallel to that of the tensioning roller 32, the idler roller 34 being mounted above and upstream of the drive roller 35. An electrical drive motor is mounted in the downstream end 26 of the casing 24 to rotate the drive roller 35 about its axis in an anticlockwise direction as seen in FIG. 2.

The three rollers 30, 32 and 34 support a conveyor belt 37 of endless construction having an upper run that extends in the longitudinal direction of the casing 24 from the tensioning roller 32 along the upper surface of the casing 24 to the idler roller 34, downwardly and around the drive roller 35, and then back to the tensioning roller 32 in a lower run parallel to the upper run. The idler roller 34 and the tensioning roller 32 may be adjusted in their bearings to align the upper run accurately with the upper surface of the casing 24 and to provide sufficient tension in the conveyor belt.

The conveyor belt 37 is constructed to allow the passage of gas through the belt whilst fibrous material entrained with the gas is deposited and retained on its surface as a web 38 of entangled fibres. For example, the conveyor belt 37, or at least part thereof, particularly the central region extending the length of the belt, is provided with perforations, slots or apertures, or is otherwise porous, to allow the passage of gas therethrough whilst supporting fibrous material on its surface. For this purpose, the conveyor belt may for example be a fabric material woven to a density sufficient to permit a desired flow of gas therethrough under pressure.

The upper surfaces of the upstream and downstream box units 24*b*, 24*a* of the casing 24 are each provided with apertures or slots that lie beneath the upper run of the conveyor belt 37, allowing gas to pass through the conveyor belt into the interior of the box units. The portions of the upper surfaces immediately surrounding the apertures or slots provide support for the upper run of the belt 37.

The box units 24*a* and 24*b* provide an exhaust chamber 40 that communicates with an exhaust gas outlet 41*a* (FIG. 1) in one side of the casing 24 through which gas may pass out of the exhaust chamber. The exhaust outlet 41*a* may be connected to a vacuum pump (not shown) to enable gas to be drawn from the exhaust chamber 40. With the partition 27 removed, the interiors of both box units may be evacuated to the same pressure. With the partition in place, the interior of the upstream box unit 24*b* may be evacuated separately from the downstream box unit 24*a*. A further exhaust outlet 41*b* (shown closed in FIG. 1) is provided in one side of the downstream box unit 24*a* to allow the part of the exhaust chamber within the downstream box unit 24*a* to be evacuated separately.

Figure 2A:
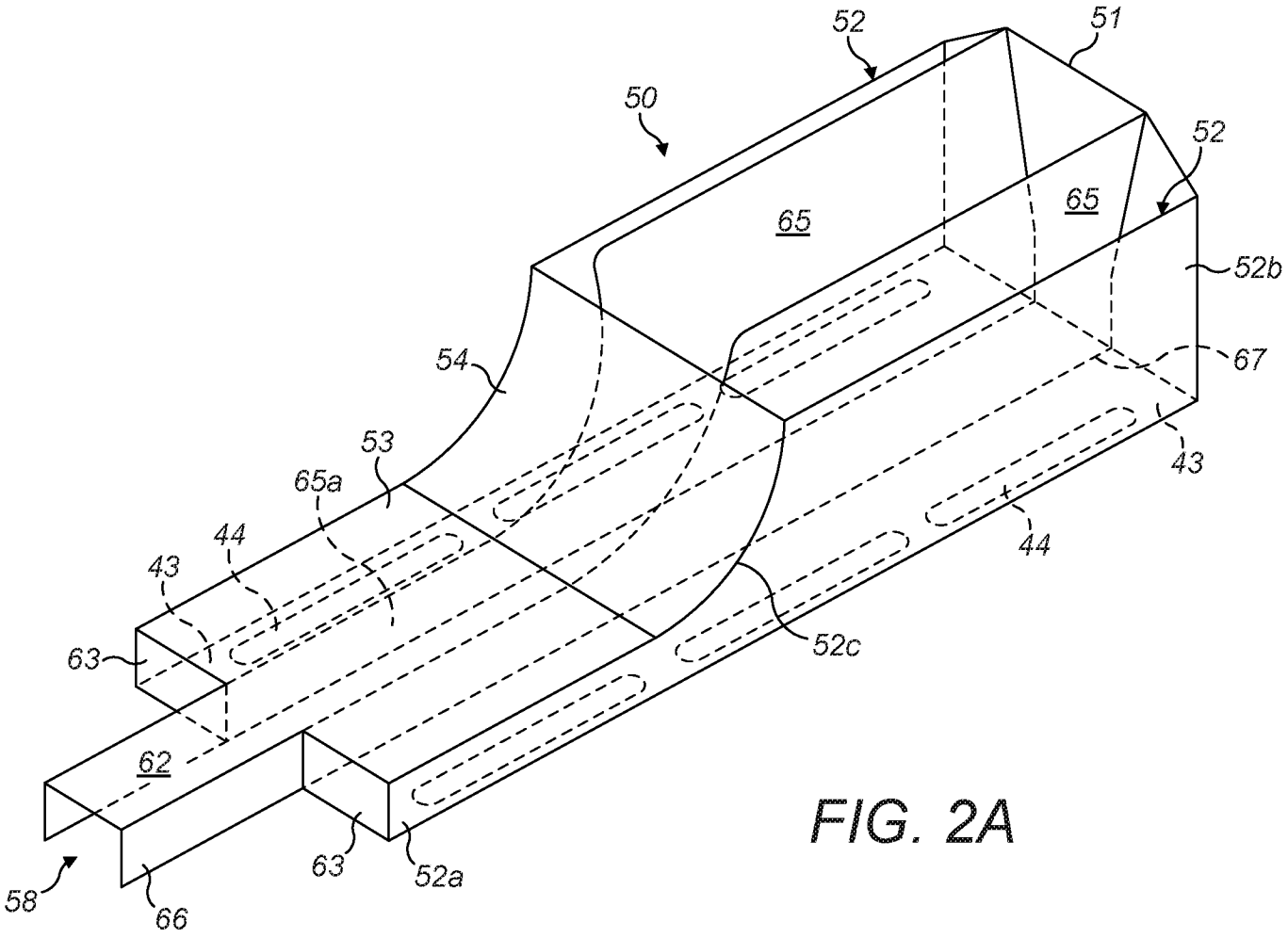
FIG. 2A is a perspective view from above and one side of an enclosure forming part of the equipment of FIGS. 1 and 2

An enclosure 50, illustrated in detail in FIG. 2A, fabricated from a sheet material such as steel, aluminium or a temperature resistant plastics material, is mounted on the casing 24 and overlies the conveyor 28 to define a chamber 10 in which the fibres from the melt blowing module 1 may be gathered together and separated from surplus gas.

The enclosure 50 together with the upper run of the conveyor belt 37 surrounds and partially encloses the path of the fibres between the die head 14 and the conveyor 28. The enclosure is formed by an upright end wall 51, which is generally rectangular with bevelled upper corners. The end wall 51 is connected to two upright side walls 52, 52 aligned in the longitudinal direction of the casing 24. Each side wall 52 comprising a generally rectangular downstream portion 52*a* and a generally rectangular upstream portion 52*b* of smaller aspect ratio than the upstream portion, so that the upstream portion of each side wall 52 is higher than the downstream portion. The profiles of the upstream and downstream portions are blended smoothly into each other by an arcuate connecting portion 52*c*.

The lower edges of the side walls 52 have inwardly-turned flanges 43, 43 (FIG. 2A) which define between them a longitudinal gap in the base of the enclosure sufficiently wide to overlie the central region of the conveyor belt 37 that carries the web of fibres 38. The flanges 43 are each provided with three longitudinally extending apertures 44, 44 that overlie corresponding apertures in the upper surface of the casing 24, allowing a flow of gas from within the enclosure 50 into the exhaust chamber 40.

The horizontal upper edges of the downstream portions 52*a* of the side walls are connected by an apron 53, which has a curved upstream portion 54 that connects the arcuate connecting portions 51*c* of the side walls to each other, thereby providing a downstream end wall for the enclosure 50, opposite the end wall 51 at the upstream end of the enclosure.

A fibre outlet 58 at the downstream end of the enclosure 50 is formed by a central longitudinally projection extending from the downstream end of the apron 53. The projection is in the form of an open-ended tunnel portion 62 of inverted U-shaped transverse cross-section overlying the central region of the conveyor belt 37 and having the same height above the conveyor as the downstream end of the apron 53. The top of the tunnel portion is integral with the apron 53, and the side walls of the tunnel are formed by extensions of baffle plates 65, 65 described below.

Two vertical end plates 63, 63 extend transversely away from the sides of the tunnel portion 62 and are connected to the downstream ends of the side walls 52,52 so that the fibre outlet 58 defines a relatively confined rectangular aperture around the conveyor.

As best seen in FIGS. 1, 2 and 2*a*, the upper edges of the end wall 51, the upstream portions 52*b* of the side walls and the apron 53 form a rectangular inlet 57 to the enclosure 50 and the chamber 10 within the enclosure. The inlet is spaced from the die head 14 to allow excess gas from the die head to escape laterally with respect to the path of the fibres, outside the enclosure. The inlet 57 is aligned with the die head 14 to receive the gas stream carrying entrained fibres 12 from the die head and to direct the fibres downwardly along the pathway 30, into the chamber 10 and on to the conveyor 28 in a direction normal to the direction of movement of the upper run of the conveyor. The conveyor 28 is correspondingly disposed to move the fibres in a direction generally orthogonally, or at right angles to the direction of the gas stream.

Within the enclosure 50, the chamber 10 has a receiving zone R, upstream of the apron 53, in which the upstream portion of the conveyor is housed in alignment with the inlet 57, and a downstream stabilising zone S, housing the downstream portion of the conveyor, which moves fibres deposited thereon through the chamber 10 to the fibre outlet 58, as indicated generally in FIG. 2. The receiving zone R and the stabilising zone S communicate through a funnel 55 formed by the arcuate connecting portions 52*c* of the side walls, the curved upstream end portion 54 of the apron 53 and the upper run of the conveyor 28. The funnel 55 forms a tapered or convergent guide, having a decreasing cross sectional area through which the fibres 12 pass into the stabilising zone S.

The receiving zone R is in communication with the exhaust chamber 40 through the apertures 44 in the flanges 44 of the side walls, the upper run of the conveyor 28, which is porous, and the apertures in the upper surface of the upstream box unit 42*b*. Gas entering the chamber 10 may therefore pass into the exhaust chamber 40 and leave the equipment through the exhaust outlet 41.

As seen in FIG. 2A, two baffles 65, 65 are positioned in the receiving zone of the chamber 10 each opposing one of the sidewalls 52. Each baffle comprises a flat plate with an elongated tongue 66 extending from its lower downstream end arranged in the longitudinal direction of the casing 24. Each baffle has an upstream edge fixed to the flat end wall 51, a lower edged 67 fixed to one of the flanges 43 on the lower edges of the side wall 52, and a curved upper downstream edge that is fixed to and conforms to the curved the apron 52. The upper edges of the elongated tongues 66 thereof lie in contact with the inner surface of the flat, downstream portion of the apron 53 and form the side walls of the tunnel portion 62.57

The baffles are positioned in the inlet 57 so as to direct the fibres in the gas stream on to the transport surface provided by the conveyor. In this regard, the baffles 65, the apron 53 and the end wall 51 form the sides of a central or primary passage 48 in the inlet. The upper parts of the baffles are curved though about 10-20° away from the vertical so that the primary passage converges in the downward direction towards the conveyor 28. The lower edges 67 of the baffles provide an exit or outlet that is directed on to the transport surface of the conveyor 37.

The baffles 65 and their tongues 66, the conveyor 28, the funnel 52, the apron 53 and the downstream portions 52*b* of the side walls 52 provide a conduit 56 for the fibres through the enclosure along the pathway 30 that decreases in cross sectional area from the inlet 57 to the fibre outlet 58.

Figure 3:
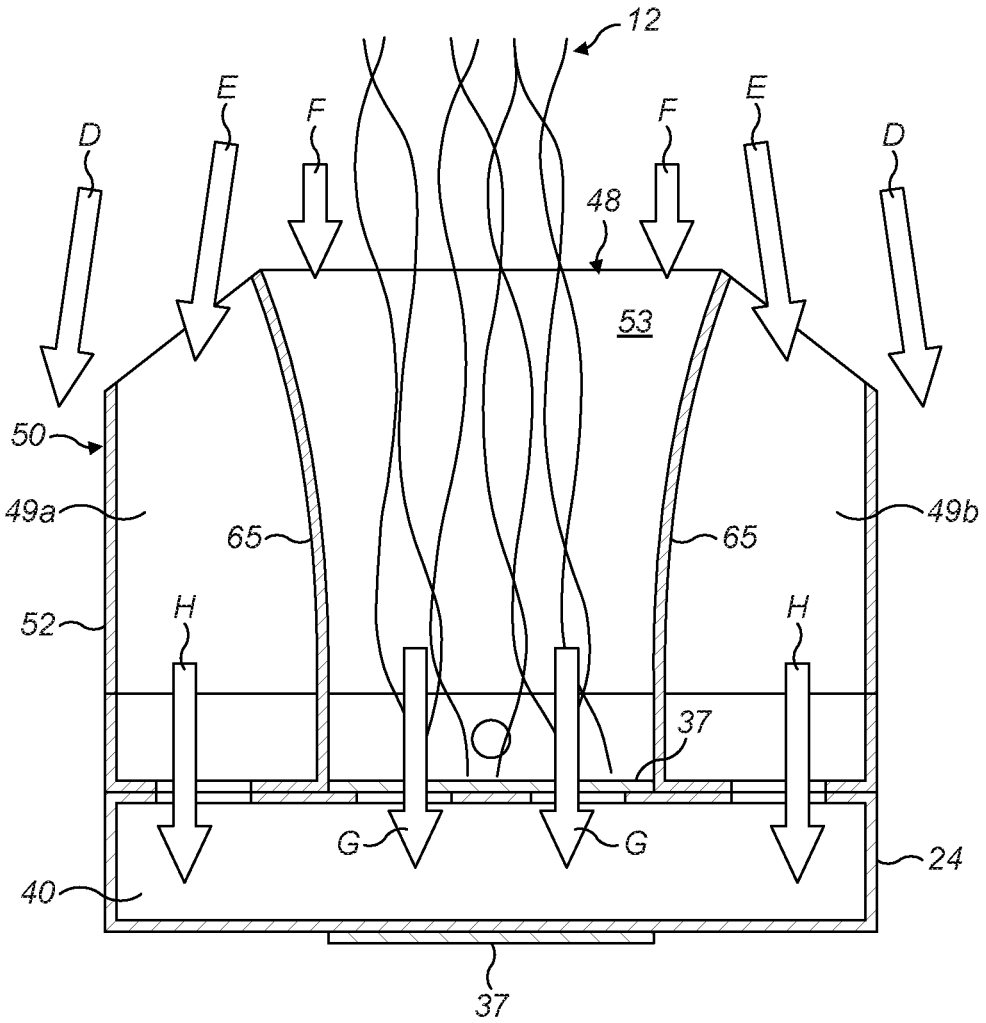
FIG. 3 is a schematic vertical cross-sectional view of equipment of FIGS. 1 and 2, taken along line B-B of FIG. 2.

Referring to FIG. 3, the upstream portions 52*b* of each of the sidewalls 52, the opposing baffle 65, the end wall 51 and the apron 53, form two peripheral or auxiliary vertical passages 49*a*, 49*b*, that lie alongside the central passage 48, each with an exit or outlet that is directed to one side of the conveyor. As a result of the inclination or curvature of the baffles, the auxiliary passages diverge in the downward direction towards the conveyor 28. Gas discharging from the auxiliary passages to the sides of the conveyor 37 passes through the conveyor belt and the apertures in the upper surface of the casing 24 into the exhaust chamber 40. The baffles 65 are thus positioned in the pathway to direct surplus gas away from the transport surface of the conveyor and thereby to reduce turbulence among the fibres 12, as described in more detail below.

The downstream portion of the stabilising zone S comprising the conduit 56 has an elongated section of substantially uniform, generally rectangular vertical cross section along it length and is arranged to receive fibres 12 which extend continuously from the die head 14 through the receiving zone R and through the funnel 55. The conduit 56 is defined by the low downstream portions 52*a* of the side walls 52 of the enclosure, the connecting portion of the apron 53 and the tunnel portion 62, and terminates in the fibre outlet 58 which lies above the downstream end of the conveyor 28 and from which the fibres 12 may be withdrawn from the chamber as a gathered web 38 of generally rectangular cross-section.

Rod Forming Module

The rod forming module 3 (FIG. 1) comprises a rigid frame 70 supporting a number of components of rod forming equipment 80-86 and a control panel 72 therefor. The rod-forming components are adjustably mounted on a rail 71 secured to the frame 70 in alignment with the path of the fibres through the fibre gathering module 2. The relative longitudinal positions of the components along the rail may be adjusted as required to match the prevailing operating conditions of the equipment.

Figure 6A:
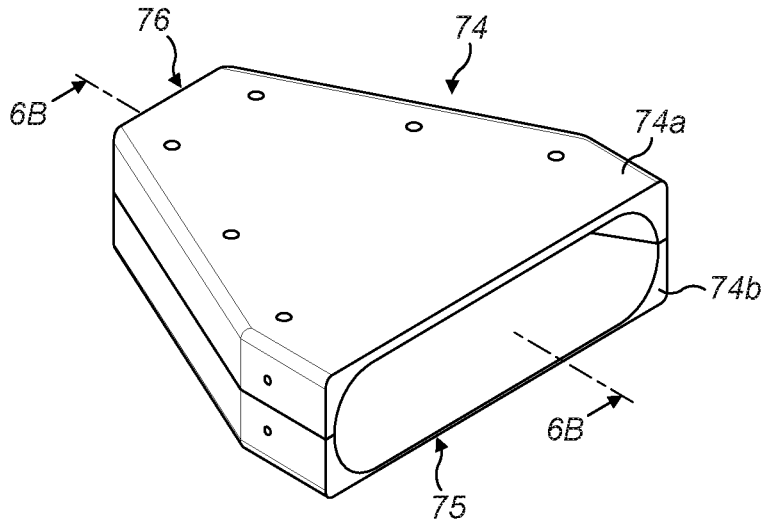
FIG. 6A is a perspective view from above and one side of a forming cone incorporated in the equipment of FIG. 1.
Figure 6B:
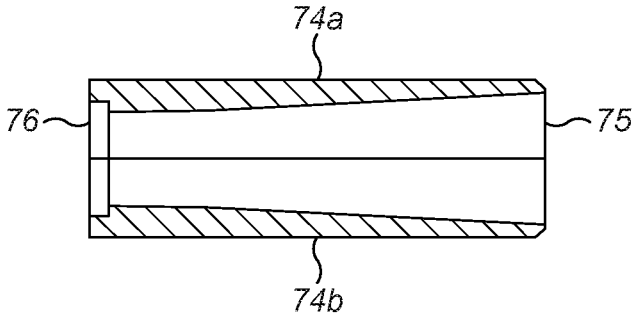
FIG. 6B is a vertical cross-section of the forming cone of FIG. 6A, taken along line 6B.

The rod forming equipment comprises a forming cone 74, which is mounted on the frame 70 in alignment with the rail 71 carrying the other rod-forming components. The forming cone 74 is composed of upper and lower half shells 74*a*, 74*b* (FIGS. 6A and 6B) each generally triangular in plan, having an outer flat surface and an inner recessed surface, which together define a tapering central passage extending in the downstream direction from a generally rectangular upstream inlet 75 to a circular downstream outlet 76. The inlet 75 is arranged to receive the gathered fibres 12 in the form of a flattened mat or web 38 directly from the fibre outlet 58 of the fibre gathering module. The tapered central passage of decreasing cross sectional area is arranged to guide and compress the fibres into a cylindrical shape as the fibres move towards the outlet 76.

Figure 7A:
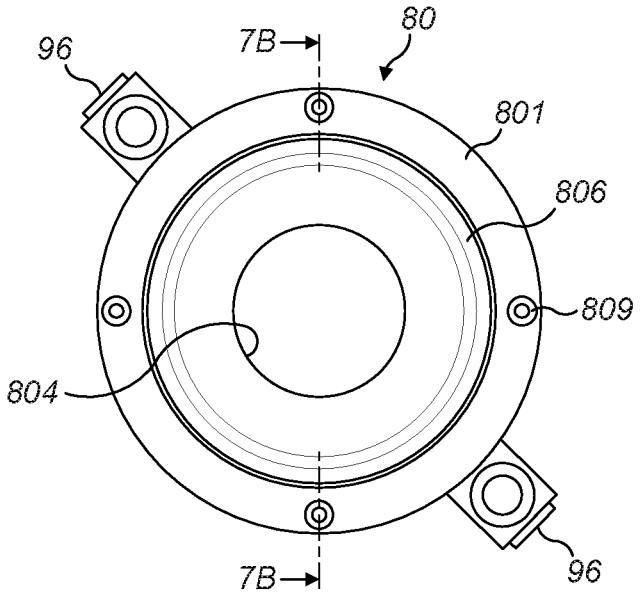
FIG. 7A is an end view of a transporter jet incorporated in the equipment of FIG. 1.
Figure 7B:
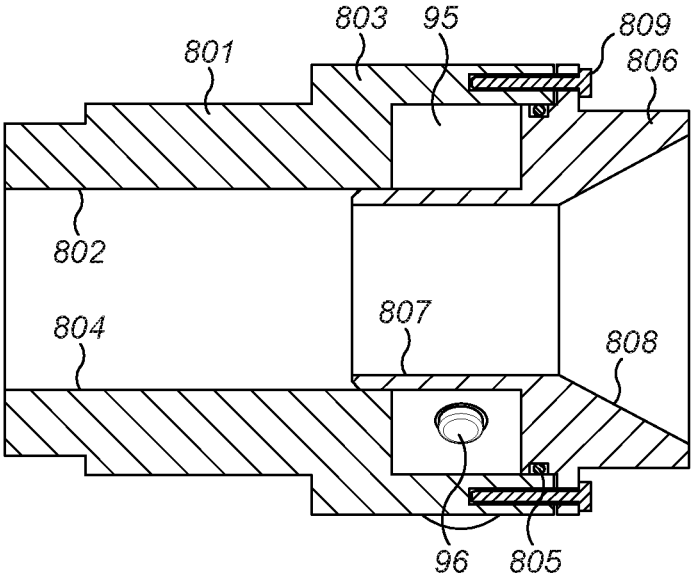
FIG. 7B is a cross-sectional view of the transporter jet of FIG. 7A, taken along line 7B.

A transporter jet 80 (FIGS. 7A and 7B) is mounted on the rail 71 to receive the cylindrically formed fibres directly from the forming cone 74. The forming cone and the transporter jet may be spaced apart axially along the rail 71 by a short distance in order to allow gas from the transporter jet 80 to vent to the atmosphere.

The transporter jet 80 comprises an outer tube 801 and a tubular insert 806. The outer tube defines a central cylindrical passage 802 which communicates with an outlet 804 at the downstream end thereof and a socket 803 at the upstream end of the tube 801, which has an internal and external diameter larger than central passage 802. The tubular insert 806 has a spigot 807 at its downstream end having an external diameter slightly less than that of the central cylindrical passage 802, and a socket 808 at its upstream end, which defines a funnel shaped entrance to transporter jet. The insert 806 is mounted in the upstream end of the outer tube 801 so that the spigot 807 of the insert is received within the upstream end of the cylindrical passage of the outer tube 801 to define a narrow annular gas passage therebetween. The socket 808 of the insert is received within the socket 803 of the outer tube 801. The inner and outer tubes are secured to each other by axially extending bolts 809 extending through a flange on the outer surface of the socket 808 of the insert into axial threaded bolt holes in the walls of the socket 803 of the outer tube. A gasket 805 received in a peripheral groove in the external surface of the socket on the insert provides an air-tight seal to the internal wall of the socket on the outer tube.

The insert 806 and the outer tube 801 are axially spaced so that an annular chamber 95 is formed between the sockets of the insert and the tube. Pressurised air may be introduced into the chamber 95 through two gas inlet connections 96 mounted on the outer surface of the socket of the outer tube. In use, gas under pressure emerges from the chamber at high speed through the gas passage between the insert and the outer tube to generate a downstream flow of air through the transported jet 80. A reduced pressure is thereby created sufficient to draw the cylindrically formed fibres into the transporter jet 80 and to transport them downstream. The mouth of the socket 808 of the insert 806 is equal in diameter to the outlet 76 of the forming cone, whereas the outlet 804 of the outer tube 801 is smaller in diameter, so that the fibres are further gathered into a rod of smaller diameter as they pass through the transporter jet.

Figure 8A:
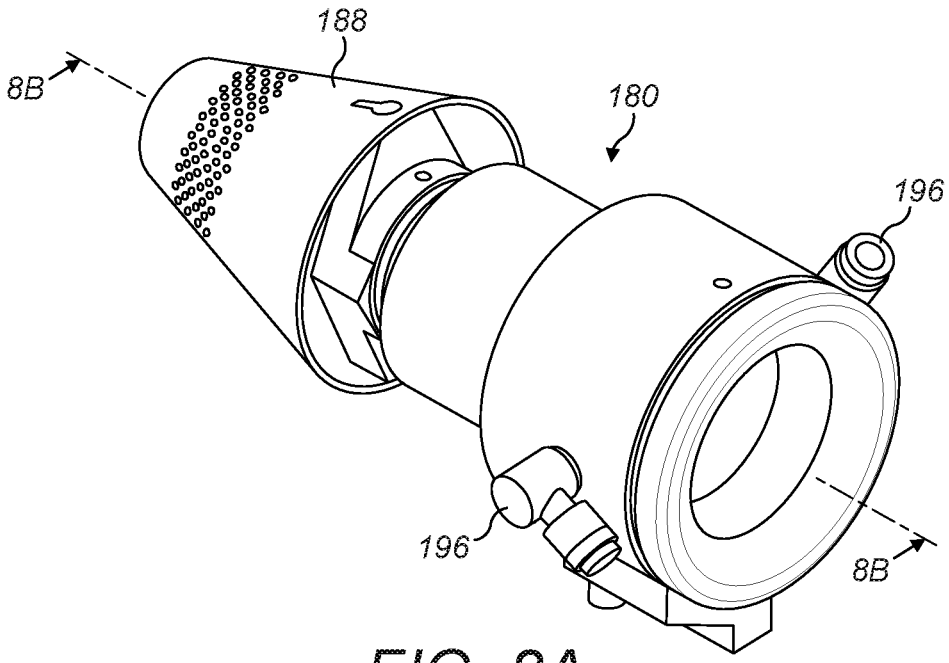
FIG. 8A is perspective view from above of a stuffer jet incorporated the equipment of FIG. 1.
Figure 8B:
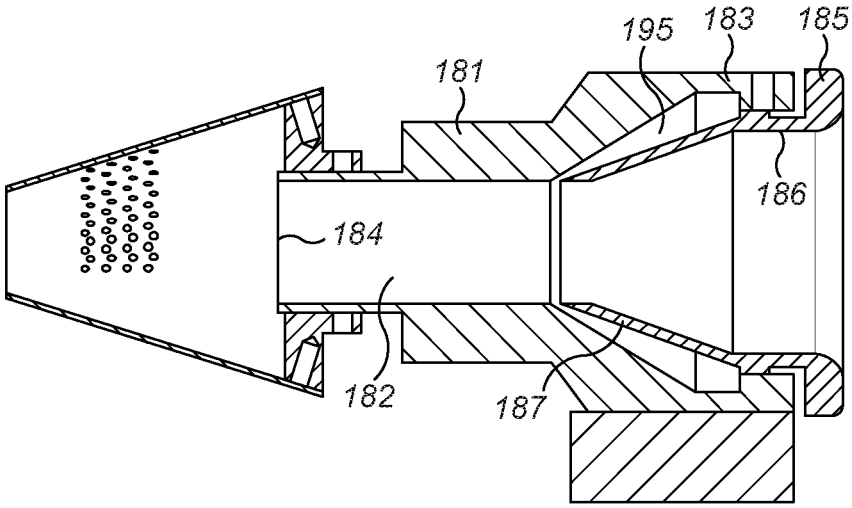
FIG. 8B is a cross-sectional view of the stuffer jet of FIG. 8A, taken along line 8B.

Immediately downstream of the transporter jet 80, and in axial alignment therewith, a further transporter jet, or stuffer jet, 180 (FIGS. 8A and 8B) is mounted on the rail 71 in axial alignment with the transporter jet 80 to receive the cylindrically formed fibres emerging therefrom. The stuffer jet 180 is similar in construction to the transporter jet 80 and performs a similar function in drawing the fibres in the downstream direction using the Venturi effect, and further compressing the gathered fibres to form a rod of still smaller diameter. The transporter jet and the stuffer jet may be spaced apart axially by a short distance in order to allow excess air from the transporter jet 80 to vent to the atmosphere.

The stuffer jet 180 comprises a tube 181 having a central cylindrical passage 182 which communicates with an outlet 184 at the downstream end thereof and a socket 183 at the upstream end. The socket 183 has a cylindrical internal surface at its open end, which is larger in diameter that the central passage 182 and a conical inner surface that tapers from the open end of the socket towards the central passage 182.

A tubular insert 186 is mounted in the socket 183. The insert 186 has a cylindrical collar at its upstream end, which defines a funnel shaped entrance to stuffer jet equal in diameter to that of the outlet 804 of the transporter jet 80. The collar is provided with a flange 185 that limits the movement of the insert 186 into the socket 183 on the tube 181. The insert is retained in the socket by means of a grub screw locate in a threaded radial bore in the wall of the socket 183. A conical spigot 187 extending axially downstream from the collar is tapered towards the central passage 182 and has an external diameter less than that of the central cylindrical passage 182.

The insert 186 is positioned axially in the socket 183 so that the conical spigot 187 and the upstream end of the cylindrical passage 182 define a narrow annular gas passage therebetween. A circular gasket may be provided between the collar and the internal surface of the socket 183 of the insert 186 to provide an air-tight seal.

The facing conical surfaces of the insert 186 and the spigot 187 are radially spaced so as to define an annular chamber 195 between them. Pressurised air may be introduced into the chamber 195 through two gas inlet connections 96 mounted on the outer surface of the socket of the tube 181. In use, gas under pressure emerges from the chamber at high speed through the passage between the tube 181 and the insert 186 to generate a downstream flow of air through the stuffer jet 180. A reduced pressure is thereby created sufficient to draw the compressed fibres into the stuffer jet 10 and to transport the fibres downstream.

A thin-walled frusto-conical nozzle 188 is mounted on the extreme downstream end portion of the tube 181. The nozzle is mounted in axial alignment with the central axis of the tube and has a diameter that tapers from its upstream end, which is larger in diameter than the downstream outlet of the tube, to its downstream end, which is of the same diameter as the central passage 182. The nozzle directs fibres emerging from the tube in the downstream direction, whist permitting excess gas to escape to the atmosphere through the large upstream end of the nozzle. Perforations are provided in the wall of the nozzle for the same purpose.

Figure 9A:
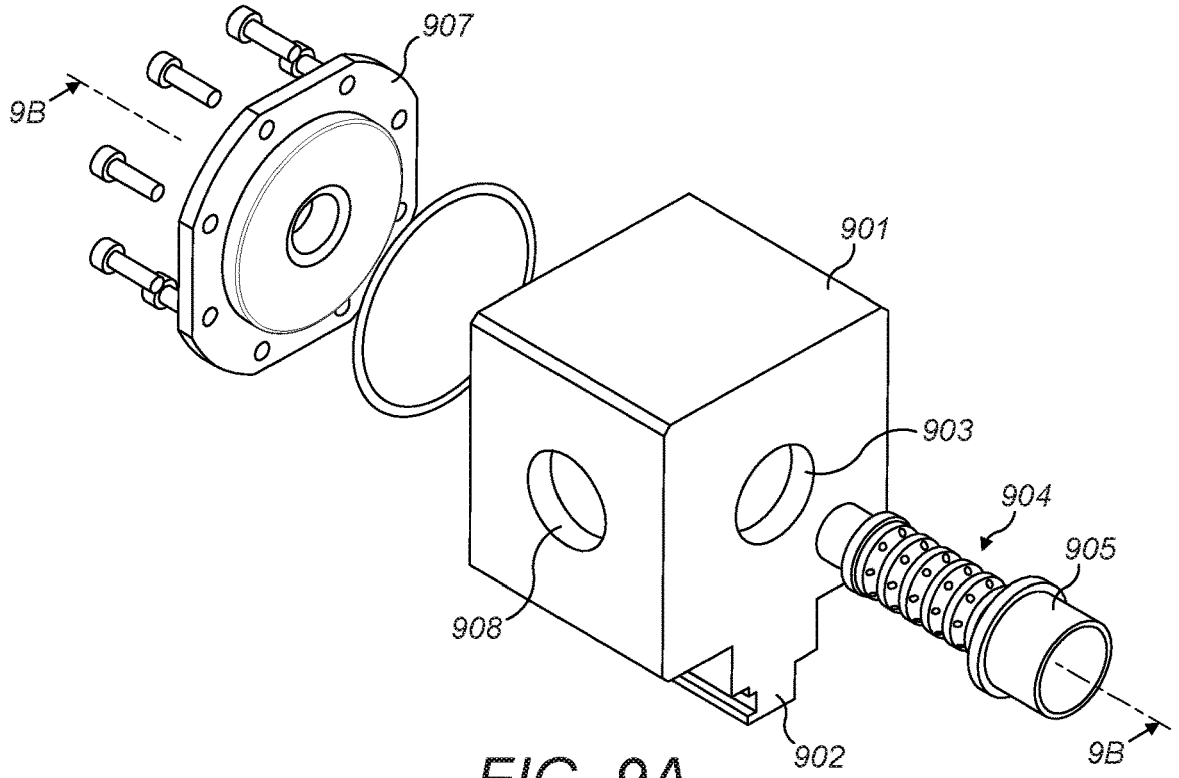
FIG. 9A is an exploded view of a steam block incorporated in the equipment of FIG. 1.
Figure 9B:
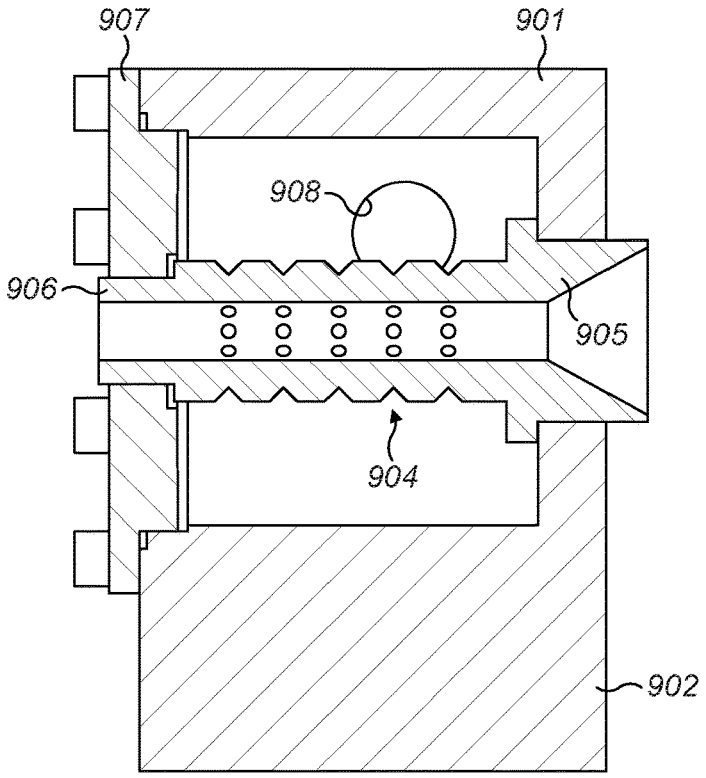
FIG. 9B is a cross section of the steam block of FIG. 9A, taken along line 9B.

A preforming block 82 is positioned on the rail 71 immediately downstream of the transport jet 180 to receive the compressed fibres. The preforming block 82 comprises a hollow cuboidal housing 901 (FIG. 9) provided with a mounting bracket 902 by which the preforming block may be secured to the rail 71. The upstream and downstream faces of the block are provided with apertures 903 for supporting a cylindrical die 904. The die 904 is in the form of a hollow tubular structure, the walls of which are provided with perforations placing the interior of the die in communication with the exterior surroundings. The upstream end of the die carries a socket 905 with an interior surface in the form of a cone that is tapered in the downstream direction to a diameter equal to the desired diameter of the filter rods. The die can be installed in the housing so that its downstream end 906 projects out of the aperture in the downstream face of the housing, and the spigot is sealingly engaged in the aperture 903 in the upstream face. A sealing plate 907 may be bolted to the housing and sealed thereto by O-rings.

The lateral faces of the housing 901 are provided with apertures 908 for receiving steam connectors (not shown) through which steam may be introduced into the housing. In use, the steam passes through the perforations in the die 904 and into contact with the fibres to increase the pliability of the rod and to facilitate formation of a rod of the desired size.

A steam block 84 is positioned on the rail 71 immediately downstream of the preforming block 82 to receive the preformed rod. The steam block is of similar construction to the preforming block, and permits superheated steam to be may be introduced into the steam block to penetrate and heat the rod to a temperature at which the fibres bond together.

An air block 86 of similar construction to the preforming block and steam block is positioned on the rail 71 immediately downstream of the steam block 84 to receive the rod from the steam block. Air is introduced into the air block to drive out any excess water from the rod.

Although occasionally some fibres may break as they pass through the equipment, most or substantially all the fibres in the rod emerging from the air block 86 extend as unbroken filaments from the air block all the way along the pathway 30 and up to the die head 14. After treatment in the air block, the finished rod may be fed into a filter plug maker (not shown), where the continuous rod produced in the equipment described is cut into individual segments.

Enclosures

Figure 4:
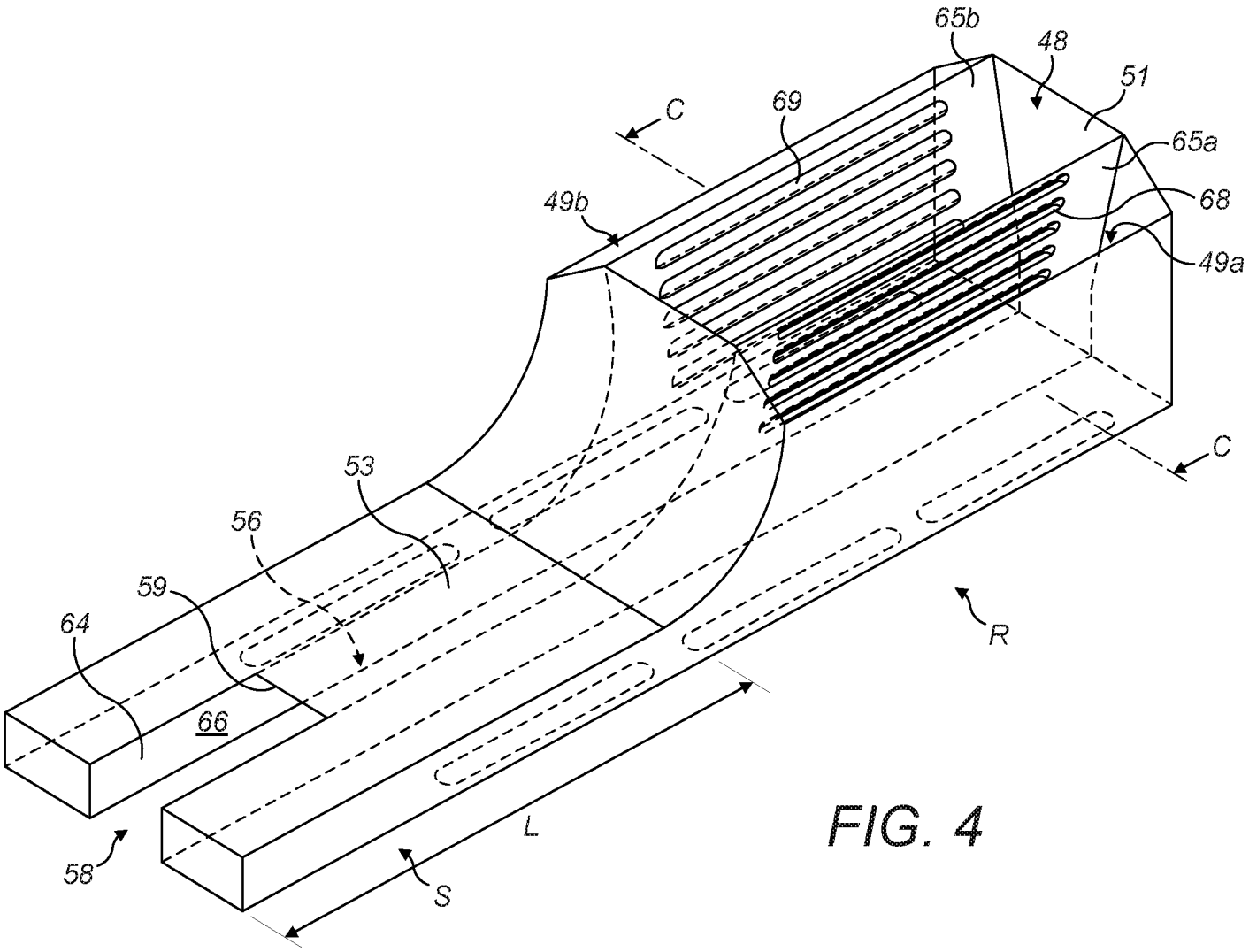
FIG. 4 is a perspective view from above and one side of a second embodiment of an enclosure suitable for forming part of the equipment of FIGS. 1 and 2, having an alternative construction to that illustrated in FIGS. 1 and 3.
Figure 4A:
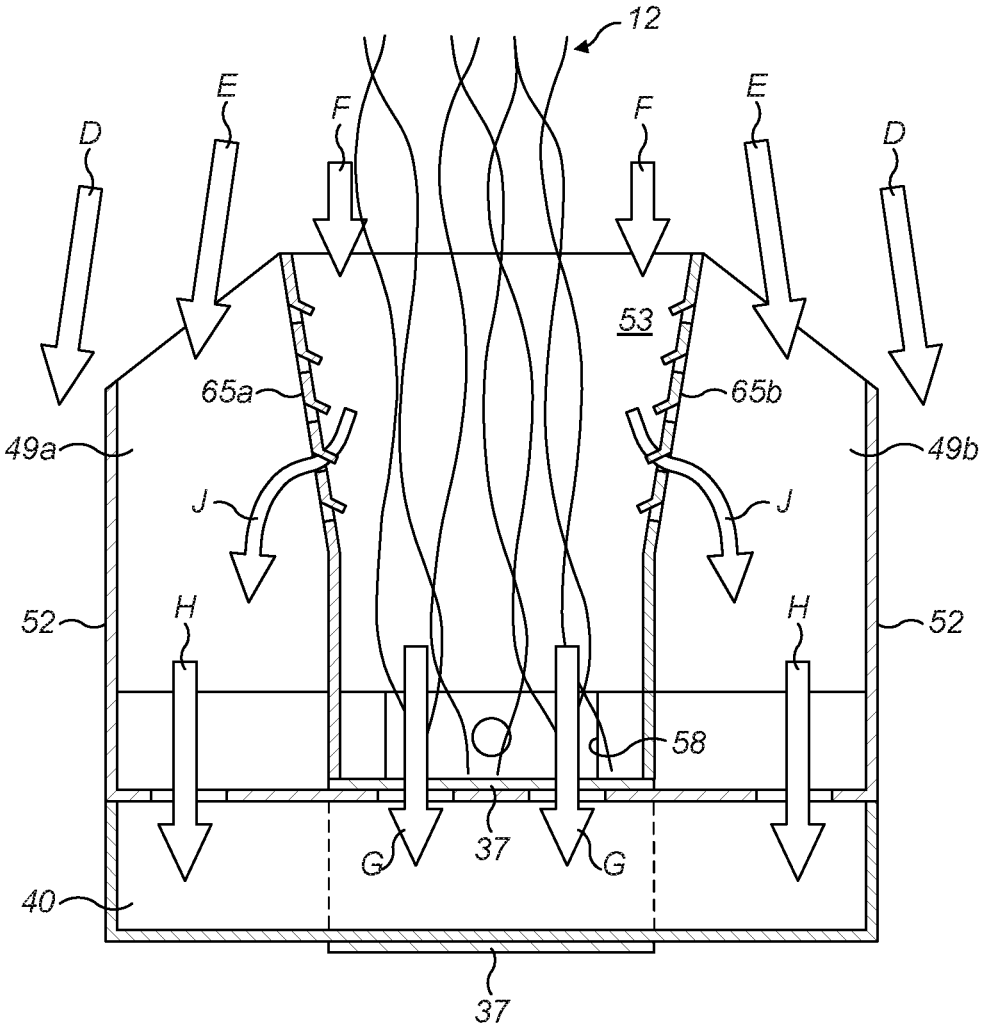
FIG. 4A is a schematic vertical cross-section of the enclosure of FIG. 4, taken along line C-C of FIG. 4.
Figure 4B:
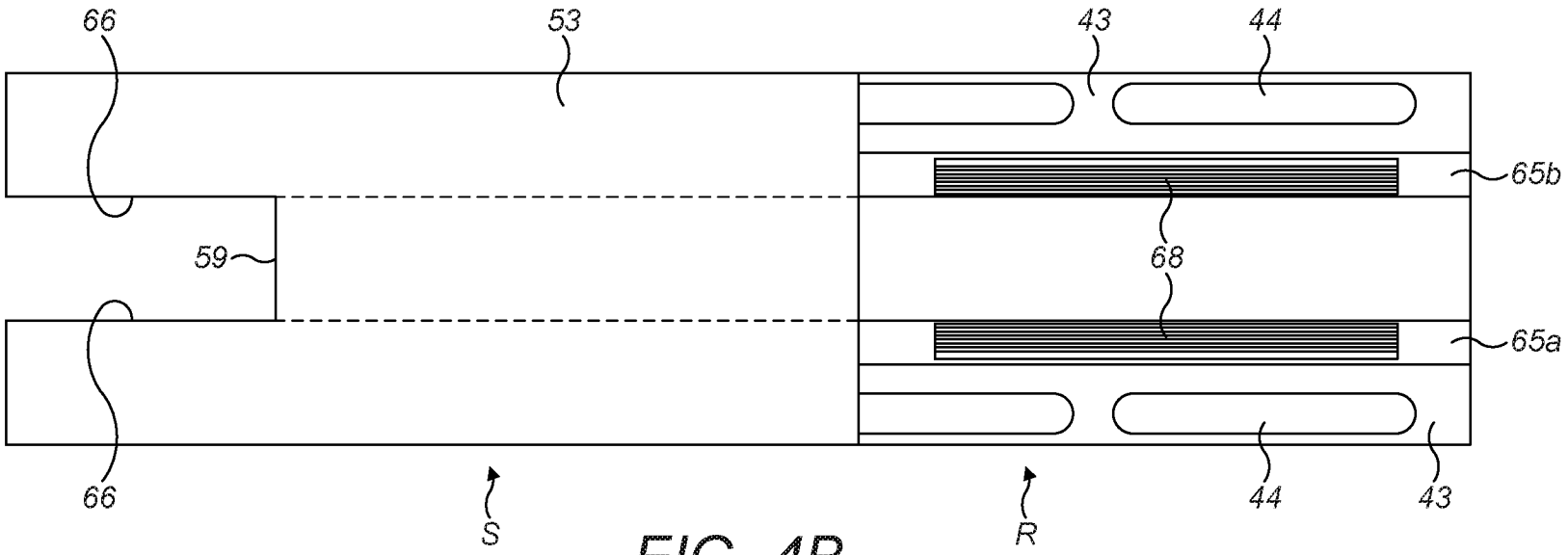
FIG. 4B is a plan of the enclosure of FIG. 4, from above.

FIGS. 4, 4A, 4B and 4C illustrate alternative enclosures for use in the equipment of the kind described with reference to FIGS. 1 to 3. The enclosure of FIGS. 4, 4A and 4B is similar in construction to the enclosure of FIGS. 1 and 2, and is constructed in a similar manner to include a rear wall 51, side walls and apron 53 that define and inlet and surround and partially enclose the path of the fibres between the die head and the conveyor 28. The enclosure includes two modifications, namely modified baffles 65*a*, 65*b*, and a modified fibre outlet 58 in the downstream portion of the stabilising zone S. Either of these features may be incorporated in equipment together or independently of the other.

In the embodiment of FIGS. 4, 4A and 4B, the two baffles 65 of the embodiment of FIG. 1 are replaced by modified baffles 65*a*, 65*b*, both of which are provided with louvres 68. Each of the louvres comprise a series of apertures in the baffle in form of parallel elongated rectilinear slots extending transversely to the direction of flow of gas over the surface of the baffle within the gathering chamber 10, arranged to divert fibres or other material approaching from one side of the baffle away from the baffle, whilst allowing gas to flow through the slot in either direction, depending upon the prevailing pressure conditions on either side of the baffle. In the baffles illustrated in FIG. 4, each of the slots is provided with a cowl 69 along its upper edge, which projects inwardly into the central passage 48 in order to deflect downwardly-moving fibres in the gas stream away from the slot and towards the middle of the central passage 48.

Figure 4C:
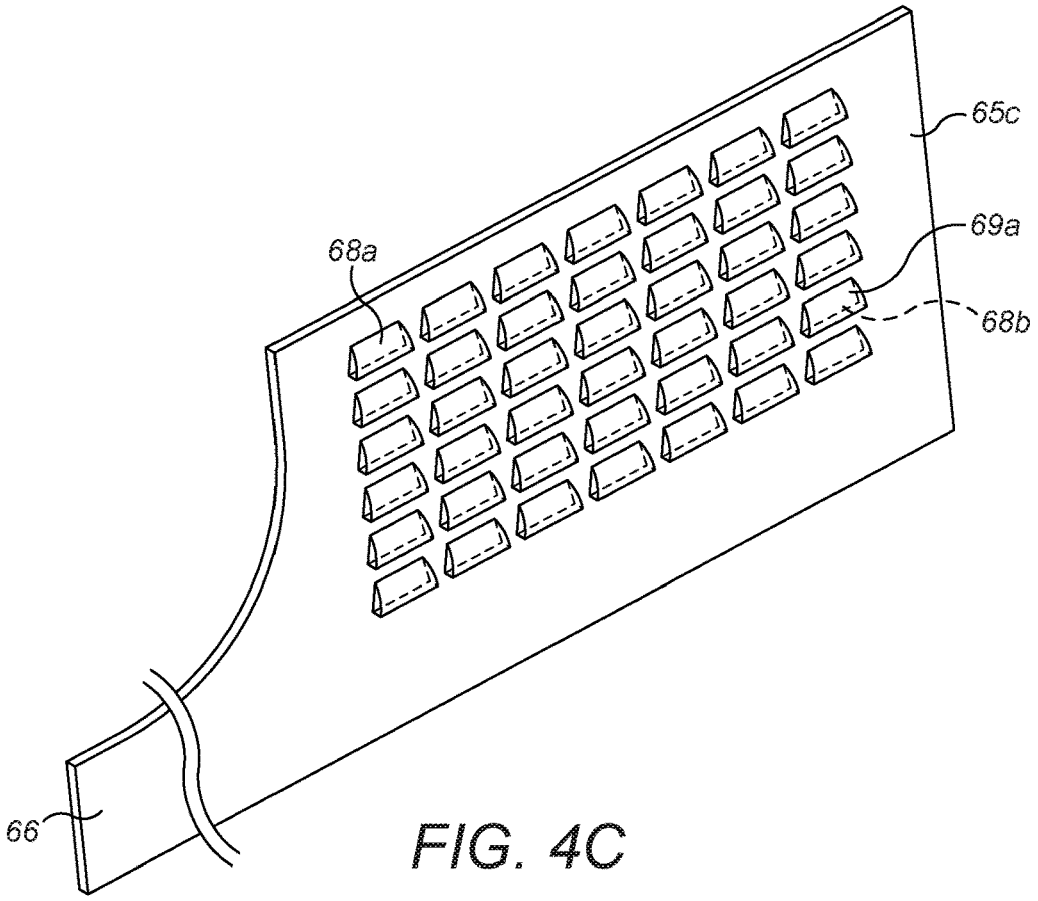
FIG. 4C is a perspective view from above and one side of a baffle that may be used in the enclosure of FIG. 4 as an alternative to the baffles illustrated therein.

FIG. 4C illustrates an alternative baffle 65*c* that may be used in the enclosure of FIG. 4. This baffle incorporates a rectangular array of louvres 68*a* arranged together in alignment in regularly spaced columns and rows. Each louvre comprises a slot 68*b* shorter in length than those of FIG. 4, and an associated cowl 69*a*. The array of relatively short louvres provides an even distribution of gas flow over and through the baffle. The flow characteristics of the baffle may be modified by providing fewer or more louvres of different dimensions and or shape. Two such baffles are used in the modified enclosure, each a mirror image of the other, so that the cowls 69*a* face inwardly on both sides of the primary passage when the baffles are installed in the enclosure.

Figure 4D:
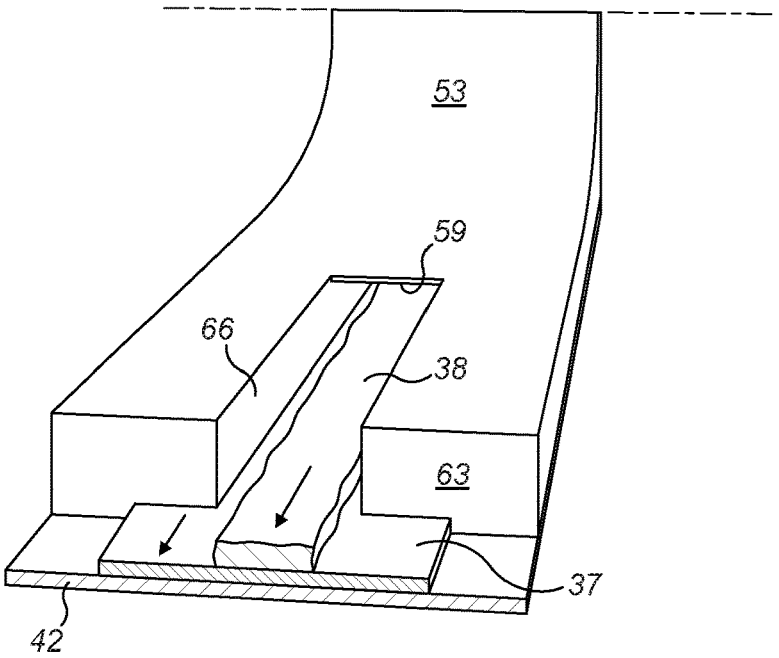
FIG. 4D is partial schematic perspective view from the downstream direction and above of the equipment illustrated in FIGS. 1 to 3.

Referring now to FIGS. 4 and 4D, the conduit 56 in the downstream portion of the stabilising zone S of the enclosure is modified in the region of the fibre outlet 58. In this embodiment, the fibre outlet 58 provides an outlet orifice 59 that discharges into a channel 64, which forms a central recess in the downstream end of the conduit. The channel 64 is bounded on each side by walls formed by elongated tongues 66 extending downstream from the baffles and arranged beneath the apron 53 on each side of conveyor. The channel is open to the exterior of the enclosure and extends in the downstream direction of movement of the gathered fibres.

The channel 64 provides a controlled release of gas from the interior of the housing in comparison with a simple rectangular aperture, the side walls of the channel reducing turbulence in the atmosphere above the conveyor. The effect of the channel is influenced by it longitudinal length, and may be selected to suit the operating conditions of the equipment, such as gas flow rate, gas temperature, internal gas pressure, conveyor speed, the vertical distance between the die head 14 and the conveyor 28, and the rate at which polymer is fed through the die head. Typically the channel may extend up to 10%, 20%, 25%, 30%, 40%, 50%, 60%, 65% or 70% of the length of the conduit, e.g. from 25 to 65%, 40 to 60% of the length L of the conduit (see FIG. 4). In the embodiment illustrated the channel extends about 30% of the length of the conduit.

FIG. 4D illustrates the web 38 of gathered fibres emerging from the outlet orifice as it is carried by the conveyor along through the channel 64. The movement of the fibre bundle in the downstream direction out of the enclosure is accompanied by a flow of surplus gas. The emerging gas stream flows more quickly than the fibre bundle and is confined by the sides of the channel 64 and the conveyor 28. The flow rate of gas downstream of the outlet orifice is also greater than the flow of gas within the enclosure. The resulting hydrodynamics of the gas as it passes out of the orifice and along the channel assist in keeping the fibre bundle clear of the sides of the channel and in releasing the fibres from the surface of the conveyor as the fibres approach the rod forming module 3.

Figure 5:
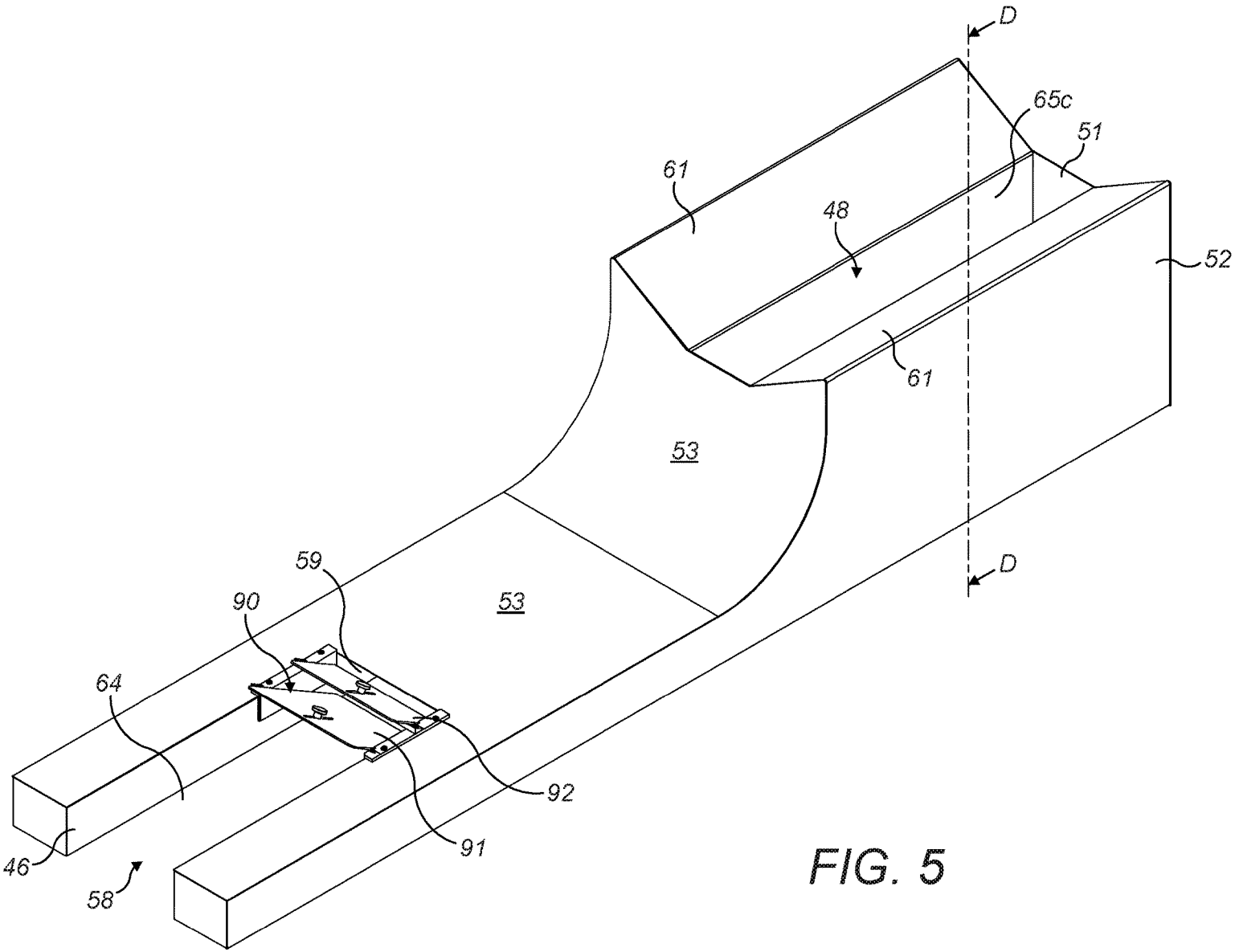
FIG. 5 is a perspective view from above and a downstream end of a third embodiment of an enclosure suitable for forming part of the equipment of FIGS. 1 and 3, with an alternative construction to those described with reference to FIGS. 1 and 3 and FIGS. 4, 4A and 4B.
Figure 5A:
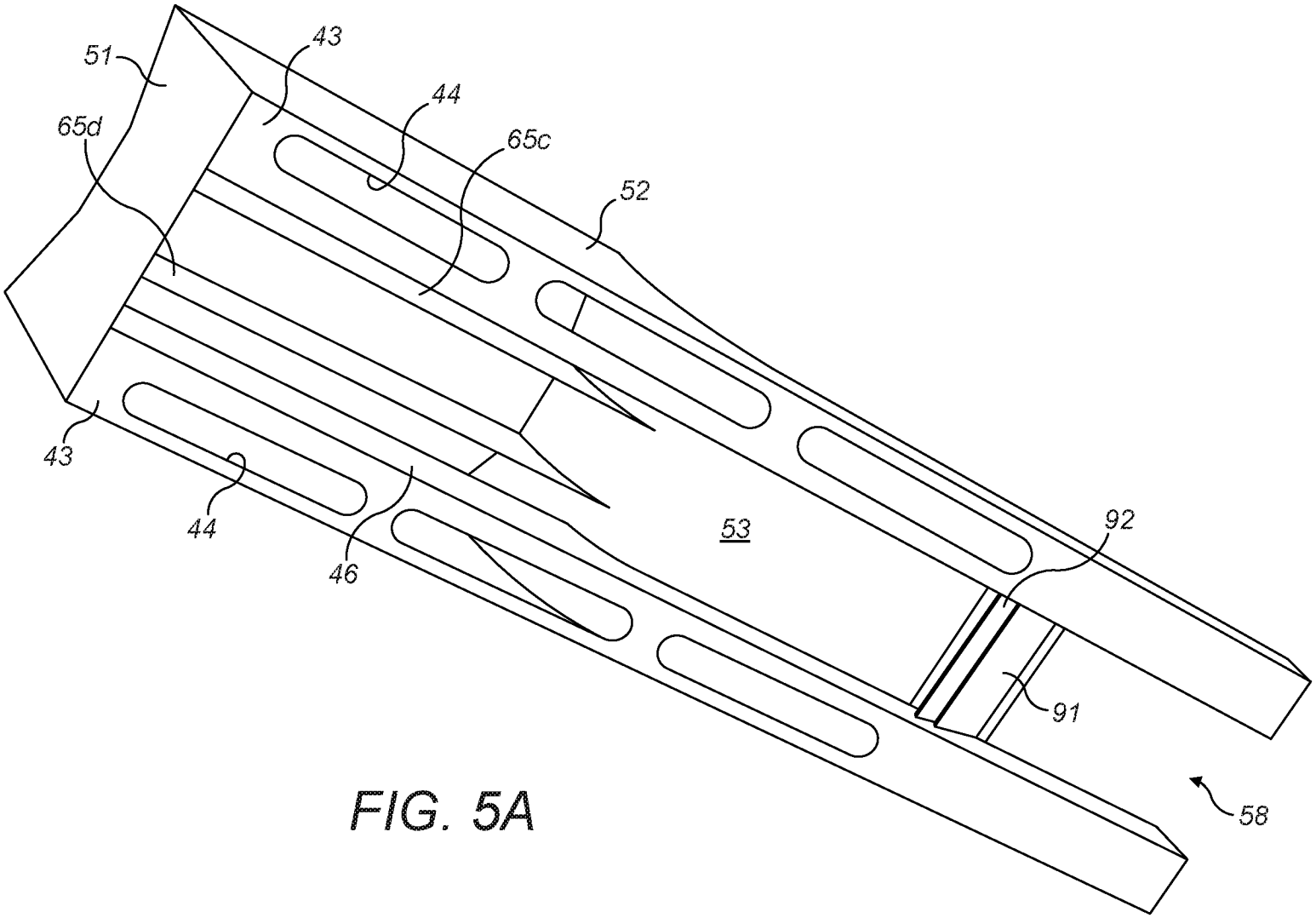
FIG. 5A is a perspective view from below and the upstream end of the enclosure of FIG. 5.
Figure 5B:
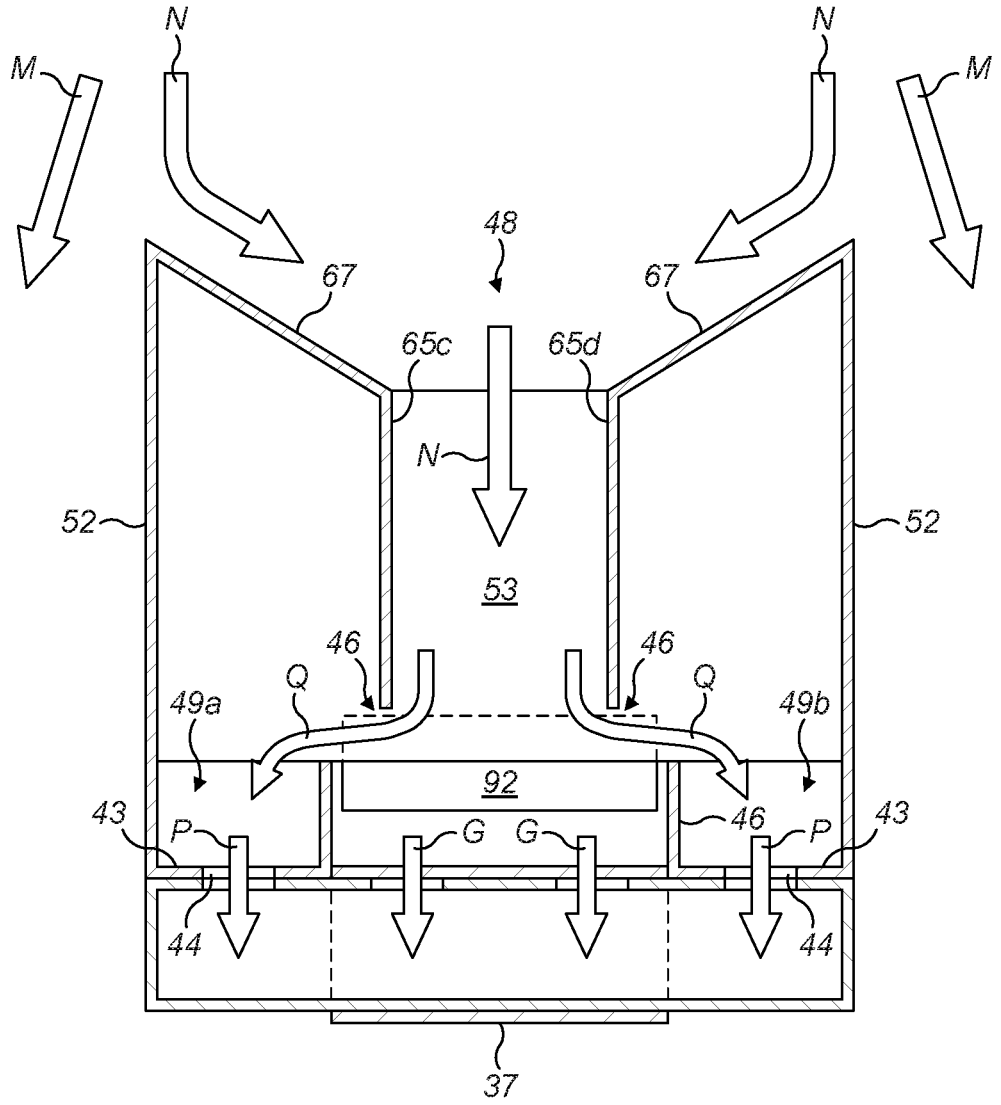
FIG. 5B is a schematic vertical cross-section of the enclosure of FIG. 5, taken along line D-D of FIG. 4.

FIGS. 5, 5A and 5B illustrate a further alternative enclosure for use in equipment of the kind described with reference to FIGS. 1 to 3. This enclosure is also similar in construction to that of FIGS. 1 and 2, but includes two further modifications, namely a modified arrangement of baffles, and a modified fibre outlet 58. Either of these features may be incorporated in equipment together or independently of the other.

The enclosure illustrated in FIGS. and 5 and 5A is constructed in a similar manner to include an end wall 51, side walls 52, 52, and an apron 53 that define an inlet for the gas and entrained fibres and partially surround the pathway of the fibres through the housing from the die head to the conveyor 28. The upper edges of the end wall 51 and the upstream end of the apron 53 are bevelled or inclined in the opposite sense from the corresponding components shown in FIGS. 2 and 3. In this case a horizontal central section of each edge is flanked on each side by a bevelled edge extending upwardly and away from the central section. Two baffles 65*c*, 65*d* are arranged within the enclosure in a similar orientation to those of FIG. 1. The baffles may be inclined in the same way as the baffles illustrated in FIG. 3, but in this case, the baffles lie in vertical planes parallel to each other and to the adjacent side walls 52. Thus, the baffles, the end wall 51 and the apron 53 form a primary passage 48 of constant cross section.

On each side, the rectangular area defined between the upper edges of the baffles, the end wall 51 and the apron 53 is closed by a deflector panel 61, 61, forming an external surface that slopes downwardly and inwardly from the upper edge of the side wall 52 towards the central passage. Each side wall 52 and its associated bottom flange 43 is formed integrally with its associated deflector panel 61 and baffle 65*c*, 65*d*, for example as a pressing. The bottom flanges 44 on the side wall also include a vertical inner return wall 46, extending along the length of the flange and forming the side walls of the channel 64. The upper edges of the return walls 46 are spaced vertically and laterally from the bottom edges of the baffle plates 65*c*, 65*d*, leaving elongated gaps 66 along the length of the chamber 10 that allow gas to flow from the outlet of the primary passage 48 laterally into the adjacent auxiliary passages 49*a*, 49*b*. The side walls 52, deflector panels 61 and baffles 65*c*, 65*d* acts as a baffle for the gas stream, capable of directing fibres into the primary passage 48 and surplus gas to the exterior of the housing.

In the enclosure of FIG. 5, the fibre outlet 58 includes an outlet orifice 59 that discharges into an open channel 64 that forms a central recess in the downstream end of the conduit, in a similar manner to that shown in FIG. 4. In this embodiment, the channel extends along about 50% of the length of the conduit. The fibre outlet 58 is modified in that, adjacent the outlet orifice 59, a baffle 90 is mounted to deflect gas emerging from the orifice upwardly, away from the direction of movement of fibres gathered on surface of the conveyor. The baffle comprises two baffle plates 91, 92 extending laterally across the channel and mounted at an angle to the plane of the downstream portion of the apron 53 so that the upstream edge of each baffle plate projects into the channel. The baffle plates may be fixed, or alternatively mounted for pivotal movement about an axis extending across the channel in order to enable the angle of inclination of the baffles to be adjusted. The baffles may be connected together in a gang to allow them to be adjusted simultaneously.

Method and Use of Equipment

The equipment of FIGS. 1 to 3 is operated as follows. In the melt blowing module 1, the die head 14 is supplied with molten polymer and hot gas. The molten polymer emerges as a liquid through the array of jets 16 and is blown by the hot air into thin streams which solidify to form small diameter fibres 12 and become entrained in the gas stream.

The die head may be configured to produce mono-component fibres from a single polymer material or bi-component fibres having a core formed from a first polymer encased in a sheath formed from a different polymer. For the production of filter rods, mono-component fibres may for example be formed from polyester, polyamide, ethyl vinyl acetate, polyvinyl alcohol or cellulose acetate, optionally incorporating other materials for modifying the properties of the polymer, for example a plasticiser such as triacetin. Bi-component fibres may be formed from any combination of the aforementioned polymers, having for example, a core of polypropylene and a sheath of cellulose acetate, optionally incorporating a triacetin plasticiser.

Using air as the blowing gas, the die head is typically positioned 25-65 cm above the upper run of the conveyor belt 37 and is operated with an air temperature of 250-350° C., e.g. 300-320° C., an air flow rate of 500-600 cubic feet or 14,000-17,000 litres per minute, and a polymer throughput of 0.3-0.5 grams per jet hole per minute. The resulting fibres typically have a diameter of 5-10 microns, e.g. about 7 microns and can be gathered to form a filter rod having a circumference of about 24 mm and a weight of about 550 mg per loan length of rod.

The stream of gas and entrained fibres 12 is directed through the inlet 57 of the enclosure 50 into the gathering chamber 10 and on to the upstream portion of the conveyor 28 in the receiving zone R of the enclosure 50. The fibres 12 gather together in an entangled mat on the upper run of the conveyor belt 37. The conveyor 28 is operated to move the belt 37 in the clockwise direction as seen in FIG. 2, thereby moving fibres relative to the direction of the gas stream, as they gather on the belt, out of the gas stream and downstream towards the fibre outlet 58.

The transporter jet 80 of the rod forming module 3 withdraws the web of gathered fibres from the chamber 10 and through the forming cone 74, which guides and compresses the fibres 12 into a rod 81 of cylindrical shape. The rod then passes through the preforming block 82, into which steam is introduced to render the rod pliable. The rod then passes from the preforming block 82 into the steam block, in which the rod is contacted under pressure, for example at a pressure of 1-3 bar, typically about 1.5 bar, with superheated steam produced for example by heating steam to a temperature in the range 150-200° C. This treatment causes the fibres in the rod to bond together at their points of contact. The rod then passes to the air block 86 which removes excess water from the rod. The formed rod 81 may then be drawn through further processing equipment, for example a cutting machine which severs the rod into consecutive segments of a desired length.

The volumes and pressures of gas necessary to form fibres by melt-blowing are such that the gas stream emerging from the melt-blowing module 14 is turbulent and capable of disrupting or interfering with the fibres, and the process for forming them into a skein, web or mat or other gathered arrangement. In particular, turbulent surplus gas can lift the mat of gathered fibres along part of the pathway, creating chaotic movement of the mat as it breaks away from the conveyor surface, which creates a non-uniform distribution of fibres in the mat, and may interrupt the manufacturing process. The susceptibility of the process to such breakaways increases with the speed at which the fibres are fed through the equipment.

In order reduce interference by the gas stream with the manufacturing process, surplus gas is separated from the fibres 12 in the gas stream as the gas and entrained fibres pass along the pathway 30 through the enclosure 50. By separating surplus gas from the gas stream and diverting it away from the gathered fibres, turbulence in the gathered fibres is reduced and the fibres 12 are stabilised. The production of a gathered product with a more uniform and consistent fibre density can therefore be achieved.

In the embodiments illustrated in the drawings, the separation of surplus gas is performed in a series of stages. As shown in FIG. 3, the fibres 12 are drawn into the primary or central passage 48 of the enclosure 50, and directed on to the upper run 37 of the conveyor by the baffles 65, 65, which converge in the direction of the conveyor. A primary separation of surplus gas from the gas stream and the fibres is made upstream of the conveyor 28 by the external walls of the enclosure, including the side walls 52 end wall 51 and apron 53. These walls direct surplus gas from an outer zone on the periphery of the gas stream away from the fibres, causing the peripheral gas to pass outside the walls of the enclosure 50 and to discharge into the surrounding atmosphere, as indicated in FIG. 3 by the arrows D, D. This primary stage of separation of surplus gas from the stream has a stabilising effect on the fibres because turbulent, excess gas is well separated from the fibres in the housing.

A secondary separation of surplus gas is made upstream of the conveyor by the baffles 65, 65, which direct surplus gas within the enclosure from inner zones of the gas stream, inwardly of the peripheral zone, into the auxiliary passages 49*a*, 49*b*, between the baffles and the adjacent portions of the side walls 52 of the housing, as indicated in FIG. 3 by the arrows E, E. The diverted gas discharges from the enclosure 50 into the exhaust chamber 40 through apertures in the upper surface of the casing 24 adjacent the upper region of the conveyor 28, as indicated by the arrows H, H in FIG. 3. The gas separated in this secondary stage is directed away from the fibres into the exhaust chamber 40 and thence to the atmosphere through the outlet 41. Turbulence in the fibres in the housing is therefore further reduced and the fibres are gathered into a web under stable conditions.

Gas and entrained fibres in a central zone of the gas stream, which lies generally inwardly of the inner zones, are directed into the central passage 48, as indicated by the arrows F, F, and on to the conveyor 28 by the baffles 65, 65, which converge in the direction of the conveyor 28. Due to the porous construction of the surface of the conveyor belt 37, the fibres 12 in the gas stream collect on the upper run of the conveyor, while surplus gas is directed from the enclosure 50 through the conveyor and discharges into the exhaust chamber 40 beneath the enclosure, from which it is evacuated through the exhaust outlet 41, as indicated by the arrows G, G in FIG. 3. The relative movement between the conveyor and the gas stream forms the fibres into a continuous web which is moved downstream out of the gas stream, at right angles thereto. Surplus gas from the gas stream in the central passage passes through the conveyor into the exhaust chamber without disrupting the fibre, thereby reducing turbulence in the housing and stabilising the web of fibres on the conveyor.

In a tertiary separation phase, the web of fibres is carried out of the receiving zone R through the funnel 55 into the conduit 56 in the stabilizing zone S, which has a transverse cross-section that conforms along its length to the desired, generally rectangular, cross section of the web on the conveyor, with a relatively small air gap above the web. The conduit may for example be from 10%, 25% or 50% or more wider than the desired width of the web, and may have an aspect ratio (width:height ratio) in the range from 10:1 to 10:5, e.g. 10:1, 10:2, or 10:3. Surplus gas entering the conduit is confined closely to the web in a substantially laminar flow, along a low turbulence or substantially non-turbulent flow path, and therefore stabilises the web as it is conveyed through the conduit.

In this embodiment, most of the surplus gas is directed to the exhaust chamber 40 and to the exhaust outlet, and a minor proportion of the surplus gas is directed to the fibre outlet 58 to leave the chamber 10 together with the fibres.

Where the equipment described with reference to FIGS. 1 to 3 is used in conjunction with the modified enclosure described with reference to FIG. 4, the pattern of flow of air and gas through the housing is as illustrated in FIG. 4A.

Referring to FIG. 4A, a primary separation of surplus gas from the gas stream and the fibres is made, as in the embodiment of FIG. 3, by the side walls 52, the end wall 51 and the apron 53, which direct surplus gas from the outer zone on the periphery of the gas stream away from the fibres into the surrounding atmosphere outside the enclosure, as indicated by the arrows D, D. A secondary separation of surplus gas is effected within the enclosure by the baffles 65, 65, which direct surplus gas from inner zones of the gas stream, into the auxiliary passages 49*a*, 49*b*, as indicated by the arrows E, E and thence into the exhaust chamber, as indicated by the arrows H, H. Gas separated in this stage can no longer cause turbulence in the fibres 12, which are gathered to form the web 38 under stabilised conditions. Again, as in the embodiment of FIG. 3A, gas and entrained fibres in the central zone of the gas stream are directed into the central passage 48, and on to the conveyor 28 by the baffles 65, 65. The fibres 12 in the gas stream collect on the upper run of the conveyor, while surplus gas is directed from the enclosure 50 through the conveyor and discharges into the exhaust chamber 40 beneath the enclosure as indicated by the arrows G, G in FIG. 3.

The louvres 68 in the baffles 65*a*, 65*b* provide an alternative route for separation of the gas from the fibres. The gas stream entering the central passage 48 experiences resistance to its flow through the passage, caused by the conveyor belt 37. The conveyor offers a higher resistance to the downward flow of gas in the central passage than that offered by the casing to the downward flow of gas through the auxiliary passages. As a result, a higher pressure of gas may develop in the central, primary passage 48 than in the auxiliary passages. In this embodiment, the louvres provide passages through which gas may flow from the central passage into the auxiliary passages, in the direction of the arrows J-J, hereby reliving the higher pressure in the central passage, improving the separation of the fibres from the gas, further reducing turbulence within the housing and improving the stability of the fibres on the conveyor.

The flow of gas and fibres through the housing described with reference to FIG. 4C is similar to that illustrated in FIG. 4A, though the characteristics of the flow of gas and fibres over and through the baffle will vary with to the pattern and configuration of the louvres.

Referring to FIGS. 5, 5A and 5B, a primary separation of surplus gas form the gas stream and the fibres is made by the upper edge of the side wall 52 and the deflector panel 61, which direct surplus gas from the periphery of the gas stream away from the fibres 12 into the surrounding atmosphere outside the enclosure, as indicated by the arrows M, M. Fibres and gas from the inner zone of the gas stream are directed into the central, primary passage 48, as indicated by the arrows N, N, N. The central passage 48 is aligned vertically with the conveyor 28, which collects fibres delivered to it by the gas stream. Some of the gas entraining the fibres passes through the conveyor into the exhaust chamber 40 as indicated by the arrows G, G. A secondary separation of the gas from the fibres is made within the enclosure by the elongated gaps 46 between the baffle plates and the side walls 52,52 of the housing, which allow gas to flow laterally, away from the direction of movement of the fibres down the central passage 48, as indicated by the arrows Q, Q, and thence into the exhaust chamber 40, as indicated by the arrows P, P. In this way, surplus gas is directed away from the fibres, causing little disturbance, and allowing the fibres to be gathered into a regular and even web on the conveyor.

A further stage of separation occurs at the outlet orifice 59, where the baffle plates 91,92 direct air upwardly away from the web of fibres as they emerge into the open channel 64. The resulting reduction in pressure above the web reduces the pressure above the web 38 and assists the transfer of the web from the conveyor into the forming cone 74.

The effect of using an enclosure according to the embodiments described above is demonstrable by comparing the performance of the equipment incorporating the enclosure with that of equipment similar to FIG. 1, but without the enclosure 50.

In the absence of an enclosure, it is found that surplus gas from the melt blowing module 1 tends to disrupt the formation of the web of fibres on the conveyor 28. Random fluctuation in the flow of surplus gas over the equipment 8 causes variations in the thickness and density of the web as it advances in the downstream direction along the conveyor, and can also cause the web to break out, or separate from the surface of the conveyor. These effects increase as the rate of delivery of fibres from the melt blowing head or the speed of travel of the conveyor 28 are increased. Consequently, in the absence of the enclosure 53, the equipment must be operated at a relatively low rate of production of the web to avoid disruptions in the distribution of fibres in the gathered fibres and variations in the density of the fibrous material formed and inconsistency in the quality of products formed therefrom.

By way of example, provided with an enclosure 53 can successfully be operated to produce fibres of 5-10 microns in diameter at a rate of production of from 150-200 m/minute or more, with, whereas operation of similar equipment without an enclosure requires a slower production rate to avoid break-out of the fibre web from the conveyor, typically 30-50 metres/minute.

In order to address various issues and advance the art, the entirety of this disclosure shows by way of illustration various embodiments in which the claimed invention(s) may be practiced and provide for superior equipment for gathering fibres entrained a gas stream and a method of forming an assembly of gathered fibres. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Apparatus comprising:

melt-blowing equipment for generating fibres of plastics material entrained in a gas stream, the melt-blowing equipment comprising a die-head having an outlet from which fibres entrained in a gas stream emerge from the melt-blowing equipment, and equipment to receive the fibres entrained in a gas stream emerging from the die-head of the melt-blowing equipment, and for gathering said fibres, wherein the equipment for receiving and gathering said fibres entrained in a gas stream comprises an enclosure having an inlet through which the fibres entrained in a gas stream are directed into a primary passage within the enclosure, a fibre outlet from which gathered fibres are withdrawn from the enclosure, and an exhaust outlet through which the entrained gas separated from the gathered fibres in the primary passage passes out of the enclosure, the enclosure being constructed to provide a pathway for the fibres through the enclosure from the inlet to the fibre outlet, wherein the melt-blowing equipment and the equipment to receive the fibres entrained in a gas stream and to gather them is spaced such that a first portion of surplus gas in which the fibres are entrained is separated from said entrained fibres as said entrained fibres are directed to the inlet of the enclosure and before the fibres entrained in said gas stream enter the enclosure, said first portion of surplus gas being exhausted to atmosphere outside of the enclosure, and wherein the enclosure comprises a baffle extending in the direction of the gas stream and the pathway for the fibres and which defines an auxiliary passage alongside the primary passage within the enclosure, the baffle being arranged to direct fibres entrained in the gas stream into the inlet of the primary passage, and a second portion of surplus gas from a periphery of the gas stream into said auxiliary passage as said entrained fibres are directed to the inlet, wherein said exhaust outlet includes an outlet from the auxiliary passage to exhaust said second portion of surplus gas to atmosphere outside of the enclosure.

2. Apparatus according to claim 1, comprising a transport system arranged to move the fibres along part of the pathway, preferably in a different direction to the direction of the gas stream, and wherein the transport system has an upstream portion disposed in alignment with the inlet to collect entrained fibres from the gas, and arranged to move fibres deposited thereon through the enclosure towards the fibre outlet.

3. Apparatus according to claim 2, wherein the transport system comprises a conveyor constructed to allow gas to pass therethrough to separate a third portion of the surplus gas from entrained fibres on the conveyor.

4. Apparatus according to claim 1, further comprising a transport surface arranged to move the fibres along part of the pathway, and at least one baffle positioned so as to direct fibre in the gas stream on to the transport surface, and surplus gas in the gas stream gas away from the transport surface.

5. Apparatus according to claim 1, wherein the primary passage has an entrance adjacent the inlet arranged to receive fibres and an exit arranged to direct fibres to a first region within the enclosure; and the auxiliary passage has an entrance adjacent the inlet and an exit directed to one side of the first region.

6. Apparatus according to claim 5, wherein the exit directed to one side of the first region directs gas to a second region within the enclosure, and the lateral widths of the auxiliary passages increase towards the second region.

7. Apparatus according to claim 1, wherein the enclosure comprises a conduit having an elongated section of substantially uniform cross sectional shape through which fibres may pass towards the fibre outlet.

8. Apparatus according to claim 7, wherein the enclosure further comprises a guide through which fibres may pass into the conduit, the guide having a cross section that tapers towards the elongated section of the conduit.

9. Apparatus according to claim 1, wherein the fibre outlet comprises an outlet orifice that discharges into an open channel extending in the direction of movement of the gathered fibres.

10. Apparatus according to claim 9, further comprising a baffle arranged to direct gas emerging from the orifice away from the direction of movement of the fibres.

11. Apparatus according to claim 1, wherein the enclosure includes an exhaust chamber arranged to receive the surplus gas, and the gas outlet is positioned in communication with the exhaust chamber.

12. Apparatus according to claim 1, wherein at least one baffle is provided with louvres.

13. A method of generating fibres of plastics material entrained in a gas stream and for gathering said fibres comprising:

generating fibres of plastics material entrain in a gas stream using melt-blowing equipment having a die-head with an outlet such that fibres entrained in a gas stream emerge from the melt-blowing equipment through said outlet, gathering the fibres entrained in the gas stream in equipment to receive the fibres entrained in a gas stream emerging from the die-head of the melt blowing equipment, wherein the equipment for receiving and gathering said fibres entrained in a gas stream comprises an enclosure having an inlet, and the fibres entrained in a gas stream are directed into a primary passage within the enclosure through said inlet, and are withdrawin from the enclosure through a fibre outlet, and an exhaust outlet through which the entrained gas separated from the gathered fibres in the primary passage passes out of the enclosure, the enclosure being constructed to provide a pathway for the fibres through the enclosure from the inlet to the fibre outlet, spacing the melt-blowing equipment and the equipment to receive the fibres entrained in a gas stream and to gather them such that a first portion of surplus gas in which the fibres are entrained is separated from said entrained fibres as said entrained fibres are directed to the inlet of the enclosure and before the fibres entrained in said gas stream enter the enclosure, said first portion of surplus gas being exhausted to atmosphere outside of the enclosure, and providing the enclosure with a baffle extending in the direction of the gas stream and the pathway for the fibres to define an auxiliary passage alongside the primary passage within the enclosure, the baffle being arranged to direct fibres entrained in the gas stream into the inlet of the primary passage, and a second portion of surplus gas from a periphery of the gas stream into said auxiliary passage as said entrained fibres are directed to the inlet, and exhausting said second portion of surplus gas to atmosphere outside of the enclosure from said auxiliary passage.

14. A method according to claims 13, wherein the fibres are gathered by directing the entrained fibres on to a collecting surface, and causing relative movement between the collecting surface and the gas stream.

15. A method according to claim 14, wherein the gas stream is funnelled in its direction of flow into a region of smaller cross-sectional area as it approaches the collecting surface and a second portion of surplus gas on the periphery of the gas stream is diverted laterally away from the direction of flow.

16. A method according to claims 15, wherein the second portion of surplus gas adjacent the gathered fibres is diverted away there from the web to facilitate separation of the gathered of the web from the collection surface.

* * * * *